US010272535B1

(12) United States Patent
Lyons et al.

(10) Patent No.: US 10,272,535 B1
(45) Date of Patent: Apr. 30, 2019

(54) METHOD FOR AUTOMATICALLY RESHARPENING A KNIFE

(71) Applicant: Sharp Systems LLC, Palo Alto, CA (US)

(72) Inventors: David Frederick Lyons, Palo Alto, CA (US); Ari Bennett, Nikiski, AK (US); Dimitriy Kolchin, Palo Alto, CA (US); Alejandro Jamarillo Gomez, Medellin, CO (US); Jeffrey Kastenbaum, Mamaroneck, NY (US); Scott DeWinter, Oakland, CA (US); Whitfield Fowler, Santa Clara, CA (US)

(73) Assignee: Sharp Systems LLC, Palo Alto, CA (US)

( * ) Notice: Subject to any disclaimer, the term of this patent is extended or adjusted under 35 U.S.C. 154(b) by 0 days.

(21) Appl. No.: 16/138,905

(22) Filed: Sep. 21, 2018

Related U.S. Application Data

(60) Provisional application No. 62/715,747, filed on Aug. 7, 2018, provisional application No. 62/659,217, filed on Apr. 18, 2018, provisional application No. 62/578,523, filed on Oct. 30, 2017.

(51) Int. Cl.
*B24B 3/54* (2006.01)
*B24B 49/04* (2006.01)
*B24B 49/12* (2006.01)

(52) U.S. Cl.
CPC ..... *B24B 3/54* (2013.01); *B24B 49/04* (2013.01); *B24B 49/12* (2013.01)

(58) Field of Classification Search
CPC ..... B24B 3/54; B24B 49/02; B24B 49/04; B24B 49/12; B24B 51/00
See application file for complete search history.

(56) References Cited

U.S. PATENT DOCUMENTS 3,484,997 A * 12/1969 Alton ..... B24B 3/54 451/194
4,602,531 A * 7/1986 Korhonen ..... B24B 3/546 451/164
4,729,191 A * 3/1988 Meyer ..... B24B 3/54 451/206

(Continued)

FOREIGN PATENT DOCUMENTS

KR 20170083412 A 7/2017

*Primary Examiner* — Timothy V Eley
(74) *Attorney, Agent, or Firm* — Run8 Patent Group, LLC; Peter Miller

(57) ABSTRACT

One variation of a method for automatically re-sharpening a knife includes: receiving a knife at a vice; during a scan cycle, scanning the grind head along a blade of the knife from an initial longitudinal position proximal the vice toward a longitudinal end position and recording a sequence of vertical positions of segments of an edge of the blade at various longitudinal positions of the grind head based on outputs of a sensor arranged in the grind head; calculating a blade profile for the knife based on the sequence of vertical positions; and, during a grind cycle, actuating a grind wheel in the grind head and pitching the grind head while driving the grind head longitudinally along the blade to maintain an axis of the grind wheel substantially parallel to segments the blade profile corresponding to longitudinal positions of the grind head, relative to the vice.

20 Claims, 11 Drawing Sheets

(56) References Cited

U.S. PATENT DOCUMENTS

| | | | | |
|---|---|---|---|---|
| 5,906,534 | A * | 5/1999 | Folkman | B24B 3/54 451/45 |
| 7,413,504 | B2 * | 8/2008 | Lytinas | B24B 3/40 451/237 |
| 8,262,438 | B1 * | 9/2012 | Allison | B24D 15/08 451/321 |
| 8,758,084 | B2 * | 6/2014 | Knecht | B24B 3/54 451/10 |
| 8,915,766 | B1 * | 12/2014 | Kolchin | B24B 3/54 451/45 |
| 9,079,284 | B2 * | 7/2015 | Christenson | B24B 3/54 |
| 10,131,028 | B1 * | 11/2018 | Allison | B24B 3/543 |
| 2018/0236623 | A1 * | 8/2018 | Robinson | B24B 53/003 |

* cited by examiner

METHOD FOR AUTOMATICALLY RESHARPENING A KNIFE

CROSS-REFERENCE TO RELATED APPLICATIONS

This Application claims the benefit of U.S. Provisional Application Nos. 62/578,523, filed on 30 Oct. 2017, 62/659,217, filed on 18 Apr. 2018, and 62/715,747, filed on 7 Aug. 2018, each of which is incorporated in its entirety by this reference.

TECHNICAL FIELD

This invention relates generally to the field of knife sharpening and more specifically to a new and useful method for automatically resharpening a knife in the field of knife sharpening.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Method

Figure 1A:
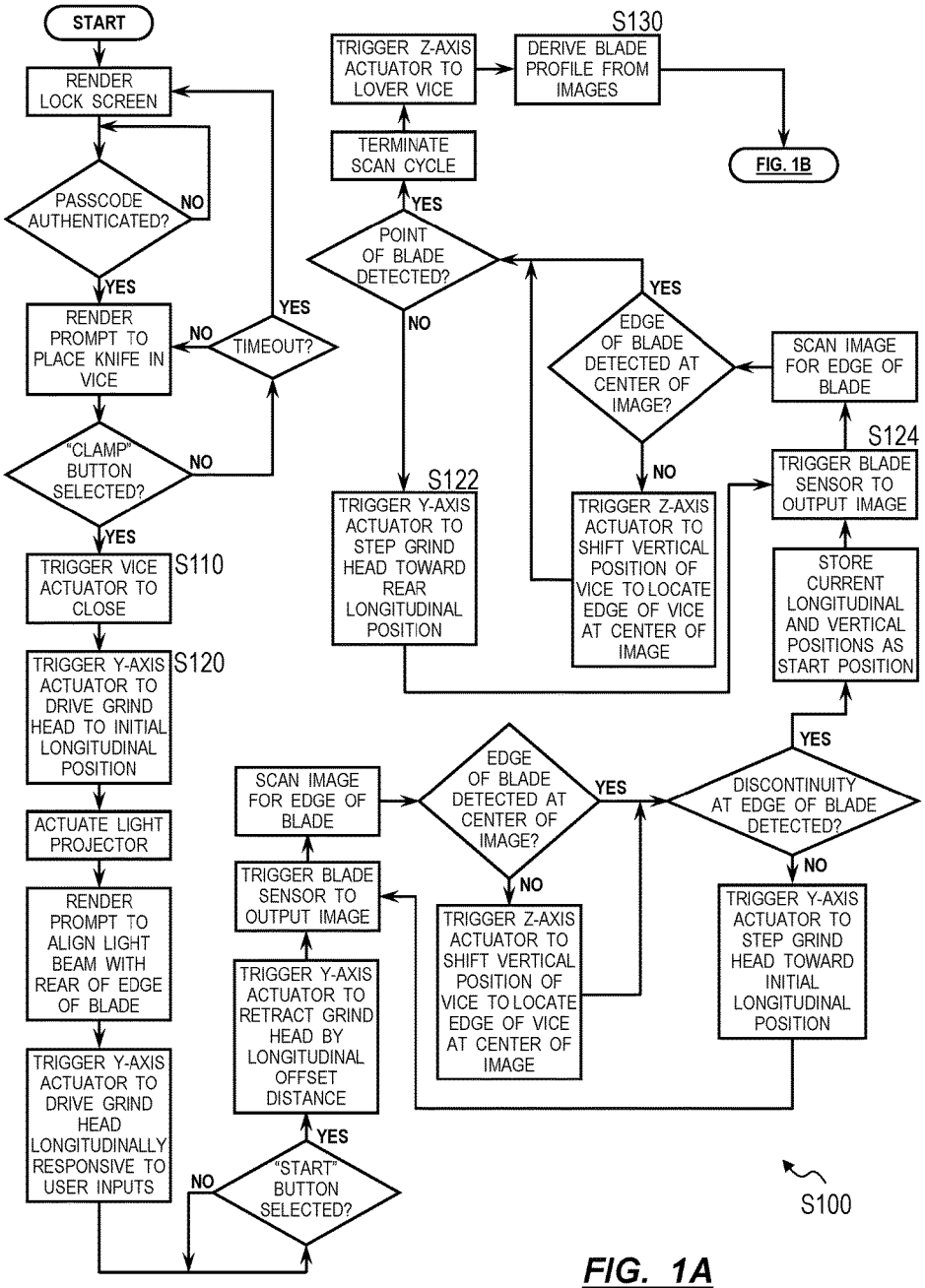
FIGS. 1A and 1B are a flowchart representation of a method.
Figure 1B:
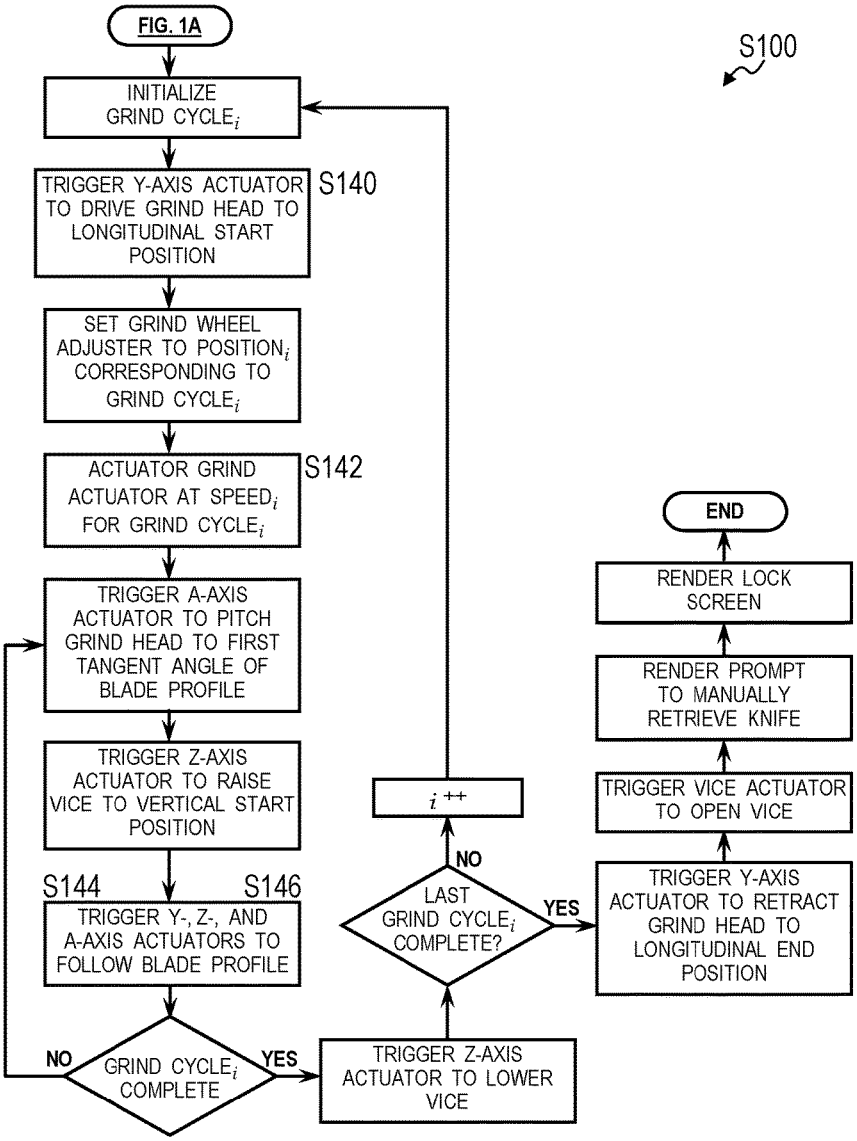

As shown in FIGS. 1A and 1B, a method S100 for automatically resharpening a knife includes receiving a knife at a vice in Block S110. The method S100 also includes, during a scan cycle: advancing a grind head, relative to the vice, to an initial longitudinal position proximal the vice in Block S120; longitudinally retracting the grind head, relative to the vice, from proximal the initial longitudinal position toward a longitudinal end position in Block S122; as the grind head retracts from proximal the initial longitudinal position toward the longitudinal end position, recording a sequence of vertical positions of segments of an edge of a blade of the knife based on outputs of a sensor arranged in the grind head in Block S124. The method S100 further includes calculating a blade profile for the knife based on the sequence of vertical positions in Block S130. The method S100 also includes, during a grind cycle: advancing the grind head, relative to the vice, to proximal the initial longitudinal position in Block S140; actuating a grind wheel in the grind head in Block S142; longitudinally retracting the grind head, relative to the vice, from proximal the initial longitudinal position toward the longitudinal end position along the blade profile in Block S144; and while longitudinally retracting the grind head, pitching the grind head, relative to the vice, to maintain an axis of the grind wheel substantially parallel to local tangents along the blade profile in Block S146.

One variation of the method S100 includes receiving a knife at a vice in Block S110. This variation of the method S100 also includes, during a scan cycle: scanning the grind head over a longitudinal scan distance between an initial longitudinal position proximal the vice and a longitudinal end position in Block S122; and recording a sequence of vertical positions of segments of an edge of a blade of the knife at longitudinal positions of the grind head along the longitudinal scan distance based on outputs of a sensor arranged in the grind head in Block S124. This variation of the method S100 further includes calculating a blade profile for the knife based on the sequence of vertical positions in Block S130. This variation of the method S100 also includes, during a grind cycle, actuating a grind wheel in the grind head in Block S142; driving the grind head along the longitudinal scan distance in Block S144; and, while driving the grind head along the scan distance, pitching the grind head to maintain an axis of the grind wheel substantially parallel to segments of the blade profile corresponding to longitudinal positions of the grind head, relative to the vice in Block S146.

2. Applications

Generally, the method S100 can be executed by an automated knife sharpening apparatus (hereinafter the "system"): to receive and retain a knife; to automatically scan the knife and derive a 2D profile of the edge of a blade of the knife (hereinafter a "blade profile") during a scan cycle; to automatically sweep a grind head—including a set of grind wheels or other blade-sharpening surface—along the blade profile in order to sharpen the blade during a grind cycle; and to then release the knife upon conclusion of a last grind cycle. In particular, the system 100 can execute Blocks of the method S100 to automatically sharpen blades of various types, shapes, sizes, geometries, conditions (e.g., levels of sharpness, edge chips), etc. without prior knowledge of these blades and without specific programing of the system 100 to sharpen a particular blade, as shown in FIGS. 7, 8, 9, and 11.

Figure 7:
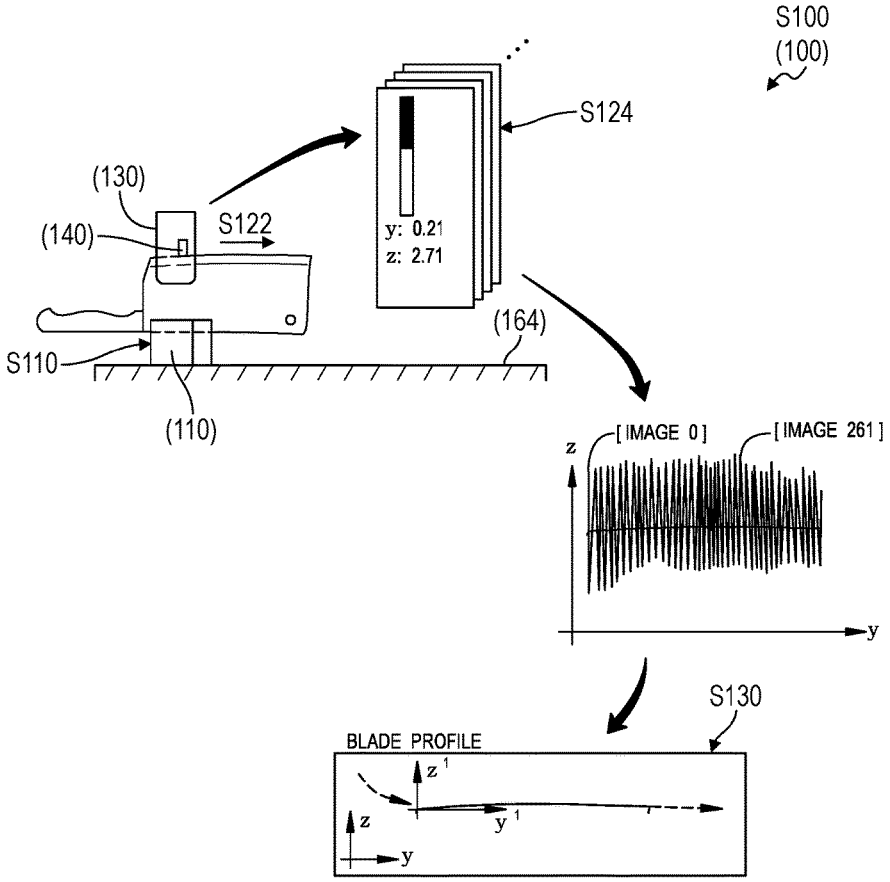
FIG. 7 is a flowchart representation of one variation of the method.
Figure 8:
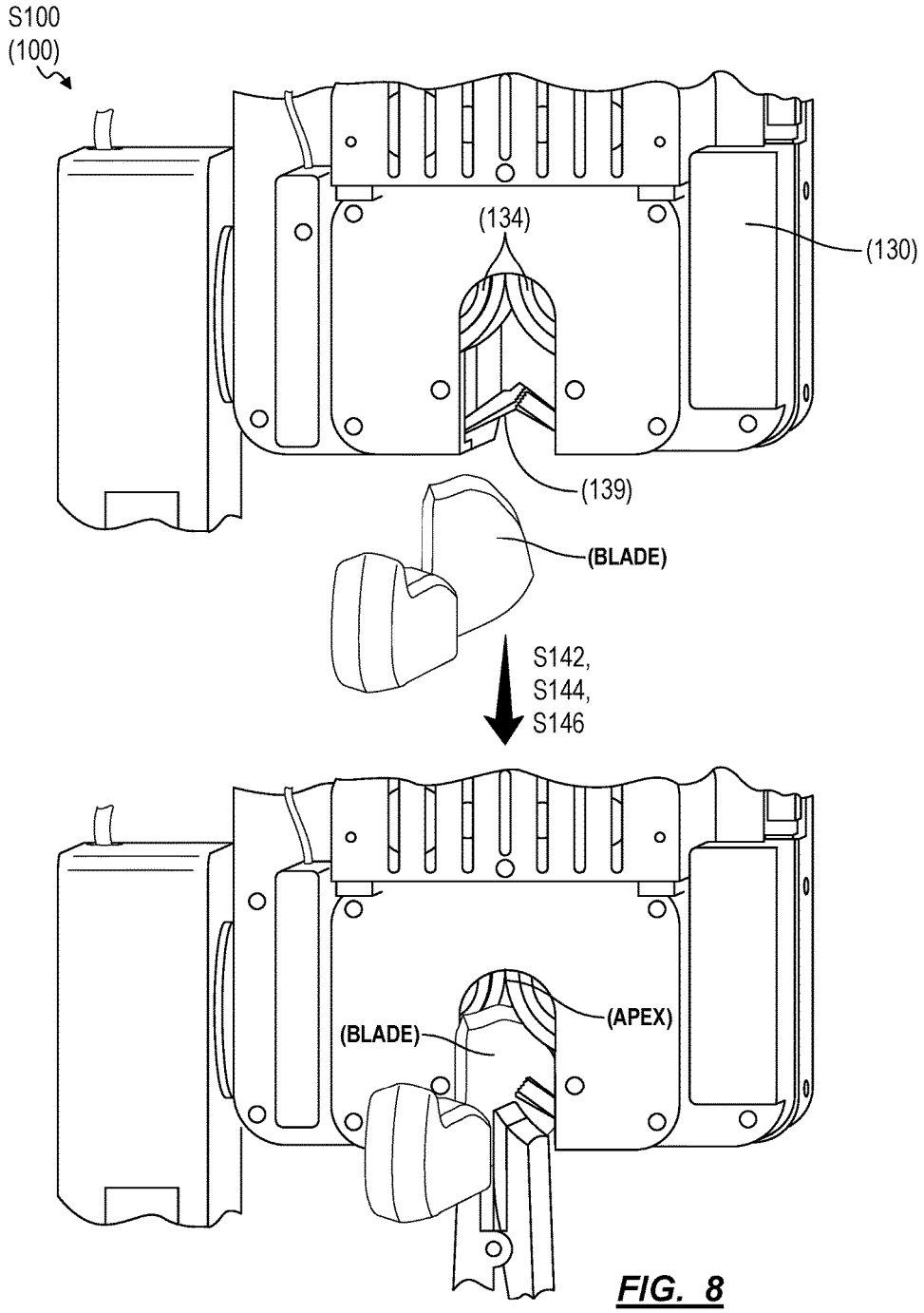
FIG. 8 is a flowchart representation of one variation of the method.
Figure 9:
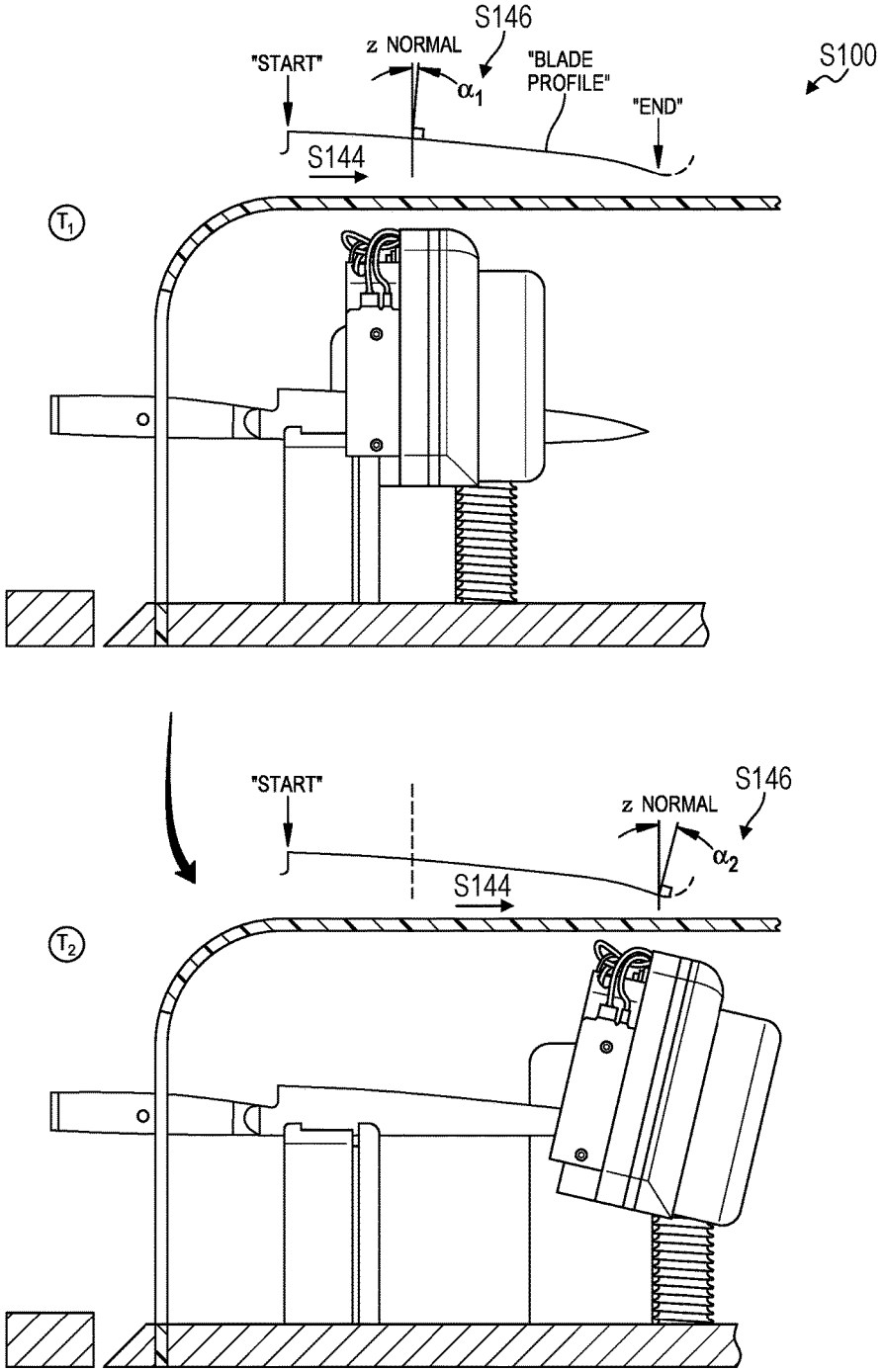
FIG. 9 is a flowchart representation of one variation of the method.

For example, once a knife is loaded into a vice in the system 100, the system 100 can execute a scan cycle according to the method S100: to record data (e.g., columnar images) output by a blade sensor while sweeping the blade sensor longitudinally from a rear (or "base") of a blade of the knife proximal the vice toward a point of the blade, to compile these data into a representation of the blade; and to extract a blade profile of the blade from this representation, such as in the form of a polynomial trendline defined in machine coordinates, as shown in FIG. 7. Subsequently, the system 100 can execute a grind cycle according to the method S100: to activate a grind actuator to rotate a pair of abrasive grind wheels within a grind head; and to sweep the grind wheels along the blade profile, including translating the grind wheels vertically and longitudinally relative to the vice and pitching the grind wheels fore and aft relative to the vice in order to maintain a surface of the grind wheels tangent and coincident the blade profile—and therefore maintain a surface in contact with a segment of the edge of the blade substantially normal to this segment of the blade—as the system 100 traverses the grind wheels along the length of the blade (e.g., from the rear of the blade toward the point of the blade), as shown in FIGS. 8 and 9.

The system 100 can also execute multiple grind cycles per knife automatically, such as: to remove chips or other defects along the edge of the blade of the knife; to grind bevels of different angles along the edge of the blade; or to perform a "roughing pass" to remove a relatively large amount of material from the blade and then a "finishing pass" to remove any burrs from the end of the blade. Upon concluding a last grind cycle according to the method S100, the system 100 can automatically release the knife and return the knife to a user.

Therefore, the system 100 can execute Blocks of the method S100 to automatically scan "dull" knives of a variety of types, shapes, sizes, etc. and to rapidly regrind these knives to a high and consistent level of sharpness with little or no manual input from a user to setup, program, or reconfigure the system 100 for knives of different types, shapes, sizes, etc. For example, the system 100 can be located: in a hardware store to automatically resharpen used knives brought to the store by customers; in a culinary store to automatically resharpen used knives brought to the store by customers and/or to sharpen new knives recently purchased by customers; or in a restaurant, deli, grocery store, or other food-preparation facility to resharpen knives for workers.

3. System

Figure 2:
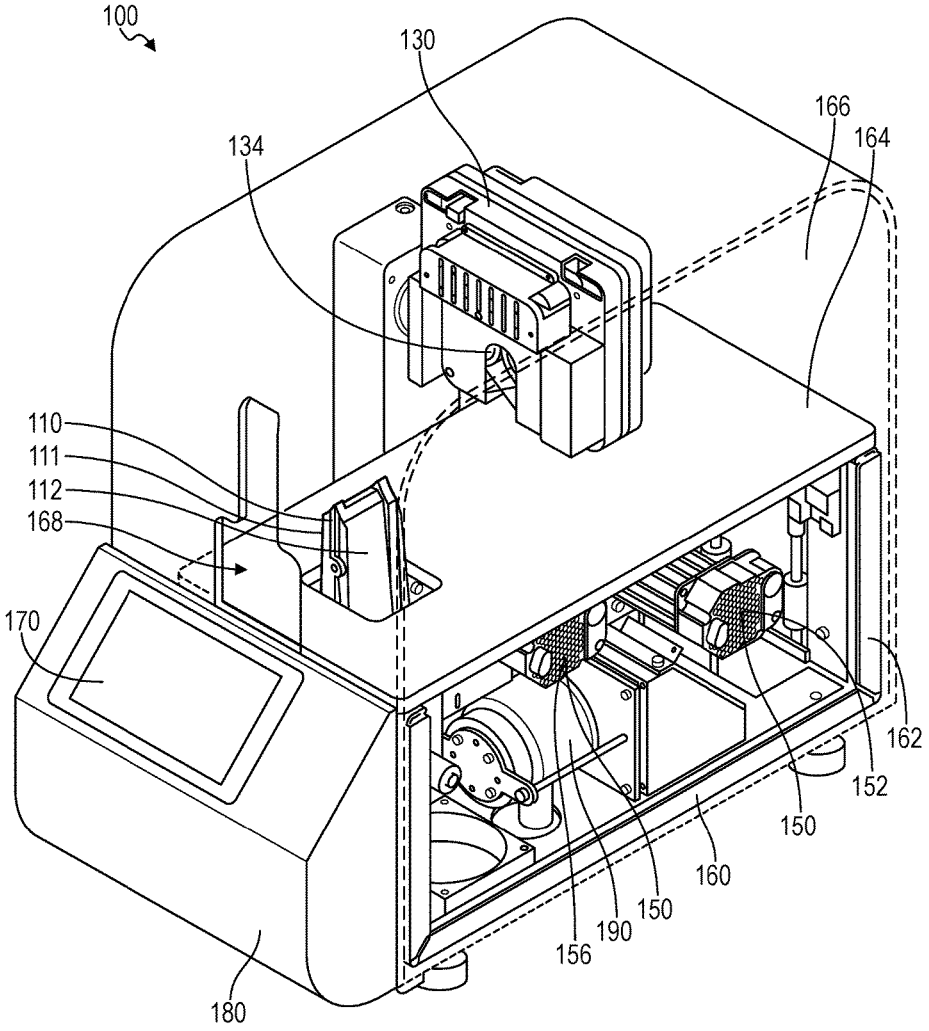
FIG. 2 is a schematic representation of a system
Figure 3:
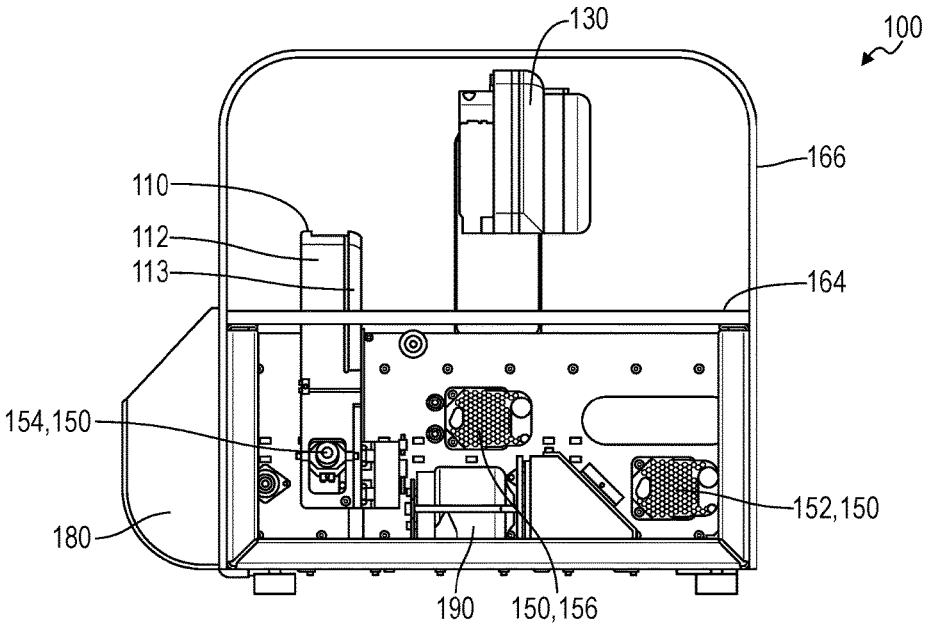
FIG. 3 is a schematic representation of one variation of the system.

As shown in FIGS. 2 and 3, the system 100 includes: a vice 110 configured to transiently retain a blade of a knife; a grind head 130 containing a pair of grind wheels 134 (or other fixed or moving blade-sharpening surface); a blade sensor 140 configured to scan the blade during a scan cycle; a set of primary actuators 150 configured to translate the grind head 130 relative to the vice 110 about longitudinal and vertical axes and to rotate the grind head 130 relative to the vice 110 about a pitch axis during scan and grind cycles; a vice actuator 120 configured to open and close the vice 110; a grind actuator 138 configured to rotate the grind wheels 134; a vacuum unit 190 configured to collect debris generated while grinding an edge of the blade during a grind cycle; a chassis 160 configured to support the foregoing elements; a lower enclosure 162 and a cover 166 configured to enclose the grind head 130, the vice 110, and the blade during a grind cycle; a user interface 170 configured to serve prompts and/or to indicate a state of the system 100 to a user; and a controller 180 configured to read sensor data from sensors throughout the system 100 and to control various actuators within the system 100 while executing scan and grind cycles according to the method S100.

3.1 Vice

Generally, the vice 110 functions to transiently receive and to retain a knife during scan and grind cycles. In one implementation shown in FIGS. 6A and 6B, the vice 110 includes: a first vice jaw 111 defining a first jaw face substantially parallel to longitudinal and vertical axes of the system 100; a second vice jaw 112 pivotably or translationally coupled to the first vice jaw 111 and defining a second jaw face facing and substantially parallel to the first jaw face; a vice stop 114 interposed between the first jaw face and second jaw face and configured to vertically support the spine of a blade set in the vice 110. The system 100 further includes a vice actuator configured to selectively drive the first and second vice jaws 111, 112 together to retain a blade in the vice 110 during scan and grind cycles and to open the first and second vice jaws 111, 112 in order to release a blade from the vice 110 upon conclusion of a grind cycle.

In the implementation shown in FIGS. 6A and 6B: the second vice jaw 112 is pivotably coupled to the first vice jaw 111 below the first and second jaw faces by a pivot fulcrum; a nut 115 is sprung against the second vice jaw 112—below the pivot fulcrum—by a vice compliance spring; the vice actuator 120 includes a motor (e.g., electric gearhead motor) pivotably coupled to the first vice jaw 111 below the pivot fulcrum and including an output shaft facing the nut 115; and a lead screw 117 couples the output shaft of the motor to the lead screw 117. For example, the vice actuator 120 can be pivotably coupled to a left side of the first vice jaw 111 with the output shaft facing the second vice jaw 112 through an adjacent bore in the first vice jaw 111. The nut 115 can be coupled to the left side of the second vice jaw 112 with the vice compliance spring 116 interposed between the nut 115 and the left side of the second vice jaw 112. The lead screw 117—rotationally coupled to the output shaft of the vice actuator 120 and supported against the first vice jaw 111 by a thrust bearing 118—can pass through the first bore in the first vice jaw 111 to engage the nut 115. Thus, when the controller 180 actuates the vice actuator 120 in a first direction, the vice actuator 120 rotates the lead screw 117 to drive the nut 115 away from the right side of the first vice and to thus drive the jaw faces of the first and second vice jaws 111, 112 together with the vice compliance spring 116 transferring force from the nut 115 into the second vice jaw 112. As the jaw faces contact and engage a blade of a knife placed over the vice stop 114, the blade can prevent further closure of the first and second vice jaws 111, 112. Continued actuation of the vice actuator 120 can thus drive the nut 115 toward the left side of the second vice jaw 112 to compress the vice compliance spring 116, which transfers a force from the nut 115 into the second vice jaw 112 proportional to a distance that the vice compliance spring 116 is compressed; the first and second vice jaws 111, 112 can cooperate to transfer this force between the thrust bearing 118 on the first vice jaw 111 and the vice compliance spring 116 on the second vice jaw 112 into a clamping force between the first and second jaw faces to retain the blade in the vice 110. Once the system 100 completes one or more grind cycles for this blade, the controller 180 can actuate the vice actuator 120 in a second direction, which rotates the lead screw 117 to drive the nut 115 toward the right side of the first vice, to thus open the vice 110, and to thus release the blade.

Therefore, in this implementation, the vice compliance spring 116 can be sized to yield by a target compression distance when a force of a target magnitude is applied by the vice actuator 120, lead screw 117, and nut 115 to close the vice 110. (The magnitude of this force at the lower end of the vice 110 can correspond to a target clamping force between the jaw faces of the first and second vice jaws 111, 112. The vice compliance spring 116 can also be preloaded to achieve this force magnitude over a narrow range of motion of the vice 110.)

In this implementation, the vice 110 can also include: an optical flag (e.g., coupled to the nut 115 or to the first vice jaw 111); and an optical break sensor 119 (e.g., a photointerrupter) coupled to the second vice jaw 112, facing the optical flag, and configured to output an optical break signal when the optical flag enters the sense field of the optical break sensor 119. For example, in this implementation, the optical break sensor 119 can be arranged between the second vice jaw 112 and the nut 115 such that the optical flag enters the sense field of the optical break sensor 119 when the vice compliance spring 116 has compressed (or extended) by the target compression distance corresponding to the target clamping force at the jaw faces of the first and second vice jaws 111, 112. The controller 180 can then cease driving the vice actuator 120 in the first direction to close the vice 110 on a blade once the optical break sensor 119 outputs an optical break signal.

Alternatively, the vice 110 can include a mechanical flag; and the vice 110 can further include a mechanical limit switch configured to output a mechanical limit signal when a detector element in the mechanical limit switch is depressed. In the foregoing example, the mechanical limit switch can be arranged on the left side of the second vice and facing the nut such that the detector element contacts the mechanical flag on the nut 115 to trigger the mechanical limit switch to output a mechanical limit signal when the nut 115 has compressed the vice compliance spring 116 against the second vice jaw 112 by the target compression distance. Yet alternatively, the controller 180 can monitor a torque output of the vice actuator 120, such as based on a current draw or back-EMF of the vice actuator 120, and interpret a clamping force between the first and second jaw faces from this value. The vice 110 can alternatively include a force sensor (e.g., a strain gage) arranged between the nut 115 and the second vice jaw 112 or between the first vice jaw 111 and the thrust bearing 118 supporting a lead screw 117; and the controller 180 can read a value from this force sensor and translate this value into a clamping force between the first and second jaw faces. The controller 180 can then cease actuation of the vice actuator 120 when closing the vice 110 when the calculated clamping force between the first and second vice jaws 111, 112 exceeds a threshold or target force magnitude.

However, the vice 110 can include any other sensor arranged in any other way within the vice 110 and configured to output a signal correlated with a clamping force between the jaw faces of the first and second vice jaws 111, 112. Furthermore, the first and second vice jaws 111, 112 of the vice 110 can be arranged in any other way and actuated by a vice actuator of other any type coupled to the first and second vice jaws 111, 112 in any other way.

3.1.2 Variation: Vice Block and Vice Compliance

Figure 6A:
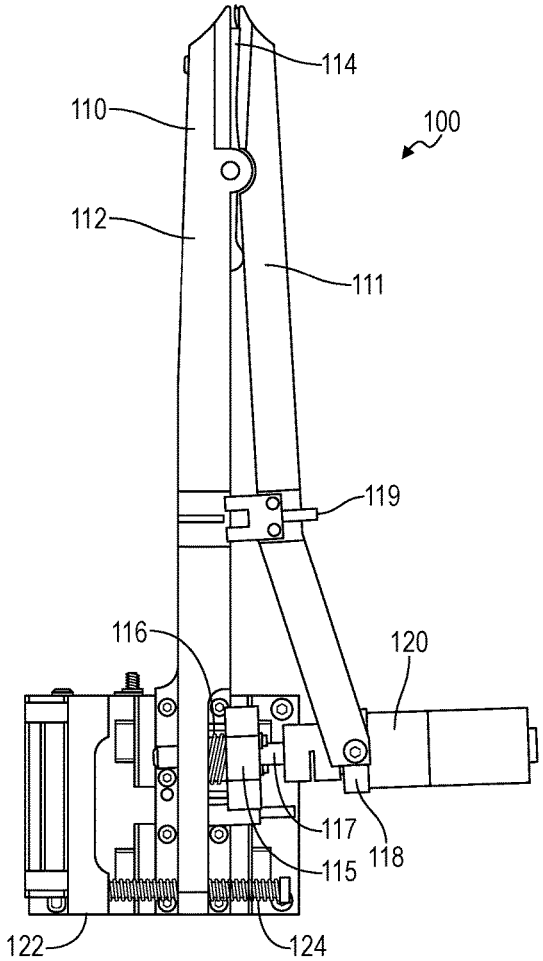
FIGS. 6A and 6B are a schematic representation of one variation of the system.
Figure 6B:
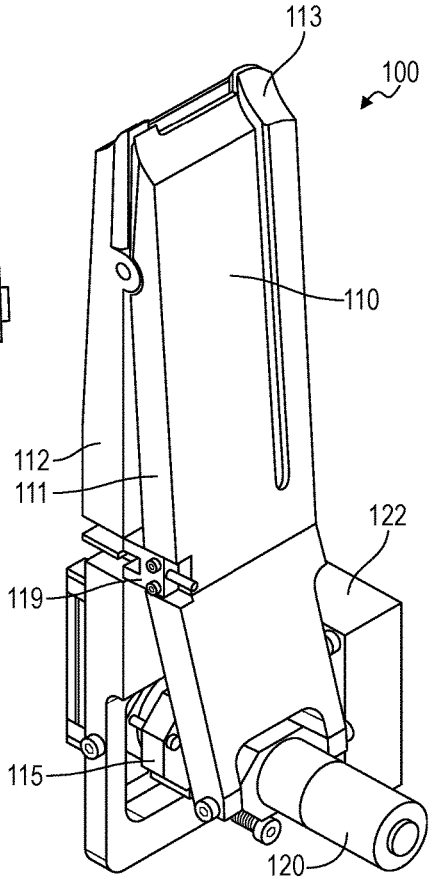

In one variation shown in FIGS. 6A and 6B, the first vice jaw 111 is mounted to a vice block; the second vice jaw 112, vice actuator, etc. are mounted to the first vice jaw 111; and the vice block 122 can be mounted to the chassis 160. Generally, in this variation, the vice block can include more mechanisms configured to yield laterally, longitudinally, and/or vertically responsive to forces applied to the edge of a blade—located in the vice 110—by the grind wheels 134 during a grind cycle. In particular, by yielding to (or "complying with") forces applied to the edge of a blade by the grind wheels 134 and communicated into the vice block 122 via the blade and the vice 110, the vice block 122 can ensure that forces between the grind wheels 134 and the blade remain substantially consistent along the length of the blade during a grind cycle.

In one implementation, the first vice jaw 111 is mounted to the vice block 122 via a vertical linear slide that locates and constrains the first vice jaw 111 relative to the vice block 122 in five degrees of freedom while enabling the first vice jaw 111—with the second vice jaw 112, vice actuator, etc. coupled to the first vice jaw 111—to translate vertically (e.g., perpendicular to the first and second jaw faces and to the vice stop 114). In this implementation, the vertical linear slide can also define a vertical stop defining an upper end of vertical travel of the first vice jaw 111 along the vertical linear slide; and the vice block 122 can further include a vertical compliance spring that biases the first vice jaw 111 against the vertical stop. When the controller 180 actuates various actuators within the system 100 to engage the grind wheels 134 to a blade clamped in the vice 110 during a grind cycle, as described below, the vertical compliance spring: can absorb variations in contact between the grind wheel and the blade (e.g., due to defects along the blade and/or limits of linear interpolation of the blade profile of the blade by actuators in the system 100 as the grind wheel moves longitudinally along the edge of the blade; and can thus maintain substantially consistent vertical force between the grind wheels 134 and the edge of the blade. For example, the vertical compliance spring can be preloaded such that the vertical compliance spring compresses the first vice jaw 111 against the vertical stop with slightly less than a target vertical grind force; however, when the first vice jaw 111 is driven downward off of the vertical stop by a target distance (e.g., 500 microns), the vertical compliance spring can apply the target vertical grind force back into the first vice jaw 111. In this example, during a grind cycle, the controller 180 can trigger actuators in the system 100 to sweep the grind wheels 134 along an adjusted blade profile offset below the original blade profile of the blade by the target distance (e.g., 500 microns) in order to achieve and maintain the target vertical grind force between the grind wheels 134 and the blade along the length of the edge of the blade.

In this implementation, the vice 110 can also include a damper between the vice block 122 and the first vice jaw 111 and configured to damp vertical oscillations in the spring, vice jaws, and blade, etc. during the grind cycle, which may otherwise cause the grind wheels 134 to skip along edge of the blade.

In this implementation, the first vice jaw 111 can also be mounted to the vice block 122 via a longitudinal linear slide that locates and constrains the first vice jaw in relative to the vice block 122 in five degrees of freedom while enabling the first vice jaw 111—with the second vice jaw 112, vice actuator, etc. coupled to the first vice jaw 111—to translate longitudinally (e.g., parallel to the first and second jaw faces and to the vice stop 114). The longitudinal linear slide can also define a longitudinal stop defining a longitudinal end of vertical travel of the first vice jaw 111—along the longitudinal linear slide—facing the rear of the system 100; and the vice block 122 can include a longitudinal compliance spring that biases the first vice jaw 111 against the longitudinal stop (i.e., toward the rear of the longitudinal travel of the first vice jaw 111 along the longitudinal linear slide). Like the vertical compliance spring, the longitudinal compliance spring can function to absorb variations in contact between the grind wheel and the blade as the grind wheel moves along the edge of the blade (e.g., downward around a tip of the blade). In particular, the vertical linear slide, longitudinal linear slide, vertical compliance spring, and longitudinal compliance spring can cooperate to maintain substantially consistent forces between the grind wheels 134 and the edge of the blade along the full length of the blade profile regardless of the angle of the grind wheels 134 relative to the blade.

In this implementation, the first vice jaw 111 can additionally or alternatively be mounted to the vice block 122 via a lateral linear slide that locates and constrains the first vice jaw 111 relative to the vice block 122 in five degrees of freedom while enabling the first vice jaw 111—with the second vice jaw 112, vice actuator, etc. coupled to the first vice jaw 111—to translate laterally (e.g., normal to the first and second jaw faces). A pair of lateral compliance springs 124 arranged on the left and right sides of the first vice jaw 111 can center an effective longitudinal center of the vice 110 with an effective longitudinal center of the grind head 130. However, the pair of lateral springs can permit the first vice jaw 111 to shift laterally relative to the vice block 122 in order to compensate for a bent blade loaded into the system 100, such as to enable the vice 110 to move laterally relative to the grind head 130 as the grind head 130 moves the grind wheels 134 along a blade profile calculated for the blade. Similarly, the pair of lateral springs can permit the first vice jaw 111 to shift laterally relative to the vice block 122 in order to compensate for adjustment of a centerline distance between the grind wheels 134, such as for the variation of the system 100 described below in which the grind head 130 includes: a first fixed grind wheel; and a second adjustable grind wheel coupled to a translational or pivotable mount configured to move the second grind wheel (laterally) within the grind head 130 relative to the first grind wheel, thereby laterally shifting an effective center of the grind wheels 134.

However, the vice block 122 can include any other vertical, longitudinal, and/or lateral compliance mechanisms in any other format or configuration; and the vice 110 can be mounted to the chassis 160 in any other way. Additionally or alternatively, the grind head 130 can be mounted on a grind head 130 block including a similar vertical, longitudinal, and/or lateral compliance mechanism.

3.1.2 Vice Variation: Magnetic Elements

In one variation, the vice stop 114 includes a set of pins pressed into bores in the first vice jaw 111 near the front and rear edges of the first vice jaw 111 and below the first vice jaw 111 and extending into oversized bores or slots in the second vice jaw 112. In this implementation, the pins can include magnetic elements configured to magnetically couple to and to retain a spine of a blade set in the vice 110 before the controller 180 triggers the vice actuator 120 to close the vice 110 against the blade. Additionally or alternatively, the vice 110 can include magnetic elements arranged in the first and/or second vice jaws 111, 112 and similarly configured to magnetically couple to and to retain a blade set on the vice stop 114.

3.1.3 Vice Variation: Secondary Jaw

In another variation shown in FIG. 6B, the vice 110 includes a secondary jaw 113: defining a narrow beam arranged at the rear of the first vice jaw 111 (i.e., opposite the knife window 168 described below); defining a secondary jaw 113 face laterally offset inwardly from the first jaw face toward the second vice jaw 112; and configured to contact, clamp against, and then deflect laterally away from a blade set in the vice 110 as the vice 110 is closed by the vice actuator 120. In particular, the secondary jaw 113 can define a secondary jaw 113 face on a distal end of a flexure cantilevered off of the first vice jaw 111 and can be configured to deflect—under forces near the target clamping force between the first and second vice jaw 11, 112 face to clamp a blade—as the vice 110 is closed in order to: compensate for variations in spine thickness along lengths of blades of various types and geometries by deflecting; while ensuring that at least a minimum clamping force is applied against a blade at the rear of the vice 110 for both a blade that tapers toward its point and for a blade with a spine of substantially uniform thickness near the base of its spines.

The vice 110 can additionally or alternatively include a similar secondary jaw 113 cantilevered off the rear of the second vice jaw 112.

3.1.4 Vice Variation: Undercut Jaw Faces

In one variation shown in FIG. 6A, the first and second vice jaws 111, 112 define jaw faces that form undercut surfaces when the vice 110 is closed. For example, the first jaw face and the second jaw face can be undercut—relative to the dorsoventral axes of the first and second vice jaws 111, 112, respectively—by 1-2° in order: to accommodate a blade that tapers (i.e., narrows) from its spine toward its edge; and to ensure engagement between the first and second jaw faces and surfaces of the blade inset from the spine, thereby establishing greater stability of the blade clamped in the vice 110.

3.1.5 Vice Variation: Replaceable Jaw Faces

In another variation, the first and second vice jaws 111, 112 are configured to transiently receive jaw faces of different types, materials, and/or geometries, such as: aluminum jaws with smooth aluminum jaw faces configured to grip blades under a threshold length and height; serrated jaws configured to grip large (e.g., tall, long) blades; and tall soft-jaws (e.g., plastic jaws) configured to grip blades with serrated spines.

3.1.6 Vice Variation: Translational Coupling

In one variation, the second vice jaw 112 is configured to translate—rather than pivot—relative to the first vice jaw 111 when the vice 110 is opened and closed. In one implementation, the vice 110 includes: a first pin rigidly mounted near the top of the first vice jaw 111 (e.g., just below the first jaw face) and free-running in a bore near the top of the second vice jaw 112; and a second pin rigidly mounted near the bottom of the first vice jaw 111 and free-running in a slot near the bottom of the second vice jaw 112. In this implementation, the first and second pins can thus cooperate with the bore and slot in the second vice jaw 112 to locate and constrain the second vice jaw 112 relative to the first vice jaw 111 in five degrees of freedom while enabling the second vice jaw 112 to translate laterally toward and away from the first vice jaw 111. The vice actuator 120 can thus be coupled to the first and second vice jaws 111, 112—such as via a nut and vice compliance spring, as described above—to open and close the vice 110.

3.1.7 Vice Variation: Manual Actuation

In another variation, rather than a vice actuator configured to automatically open and close the vice 110 responsive to commands received from the controller 180, the vice 110 can instead be manually actuated. For example, the vice 110 can include a quick-release overcam or thumbscrew mechanism, and the controller 180 can serve prompts to a user to: manually clamp a blade in the vice 110; verify that the blade is secure before executing scan and grind cycles; and then manually remove the blade from the vice 110 upon conclusion of a grind cycle.

However, the vice 110 can be automatically or manually actuated in any other way.

3.2 Grind Head

Figure 5A:
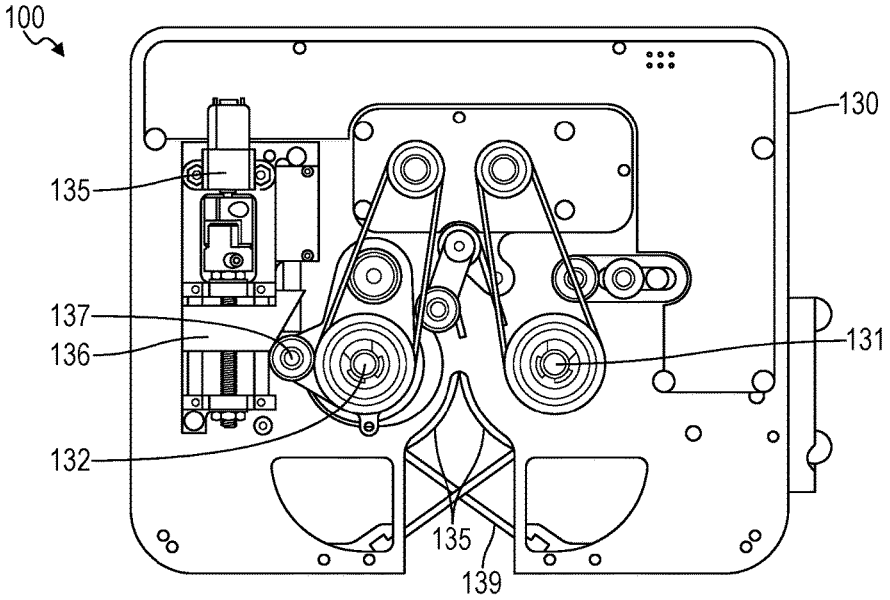
FIGS. 5A and 5B are a schematic representation of one variation of the system.
Figure 5B:
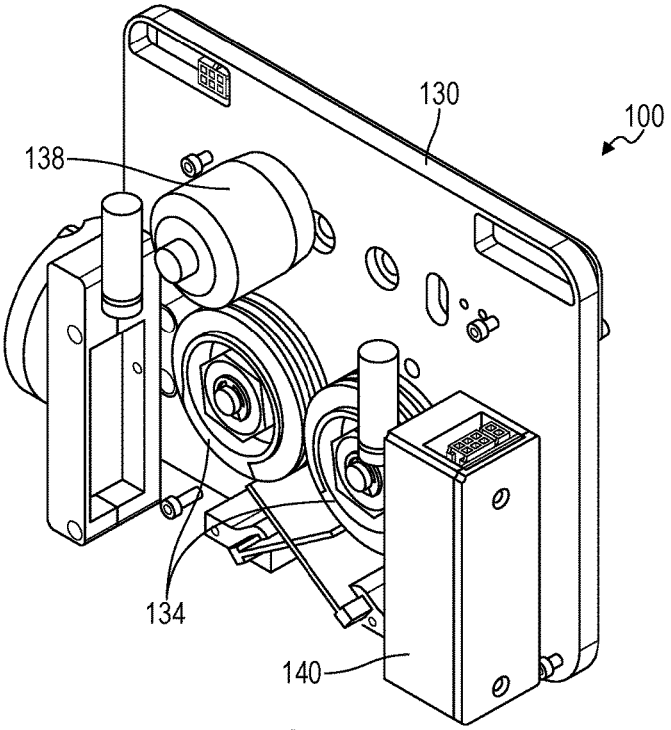

As shown in FIGS. 5A and 5B, the grind head 130 includes a pair of grind wheels 134 and a grind actuator 138 configured to actuate (i.e., rotate) the grind wheels 134. Generally, during a grind cycle, the controller 180 actuates the grind actuator 138 and drives the primary actuators 150 to sweep the grind head 130—relative to the vice 110—along a blade profile generated for a blade currently occupying the vice 110, thereby setting the grind wheel against the edge of the blade and substantially normal to the edge of the blade as the grind wheels 134 are swept along the length of the blade.

3.2.1 Grind Wheels

In one implementation shown in FIGS. 5B and 8, the grind head 130 includes a pair of helical, interdigitated grind wheels 134, wherein each grind wheel defines a helical grind surface with an abrasive coating or abrasive features (e.g., burrs, serrations). For example, each grind wheel can be: forged in steel into a (approximately) cylindrical wheel; ground or machined to form a cylindrical or ellipsoidal grind surface profile; and ground or machined to cut a deep helix into the grind surface. The grind surface can then be: polished; case hardened; hard-chrome plated; and then coated with an abrasive (e.g., a diamond-based 80-grit abrasive coating). In this example, the first grind wheel can be ground with a left-hand helix; and the second grind wheel can be ground with a left-hand helix.

3.2.2 Grind Wheel Mounting and Actuation

In the foregoing implementation, the grind head 130 can include: a first axle 131 configured to engage and support the first grind wheel; a second axle 132 configured to engage and support the second grind wheel; and a grind actuator 138 coupled to the first and second axles 131, 132, such as via two separate timing belts or via single serpentine timing belt, such that the first and second axles 131, 132 counter-rotate when the grind actuator 138 is active. In this implementation, a centerline distance between the first and second axles 131, 132 can be less than the major diameter of each grind wheel such that helical sections of the first and second grind wheels 134—mounted to the first and second axles 131, 132, respectively—interdigitate (or "interleave"). Furthermore, the timing belt(s) can maintain a phase (or "clocking") between the first and second axles 131, 132 to prevent interdigitated faces of the first and second grind wheels 134 from crashing against one another when the grind actuator 138 is active, as shown in FIGS. 6A and 6B.

3.2.3 Grind Wheel Surface Profile

In one implementation in which the grind wheels 134 define cylindrical grind surfaces, these interdigitated grind wheels 134 can overlap to form an effective linear apex parallel to, centered between, and offset below the centerlines of the first and second axles 131, 132.

Figure 10A:
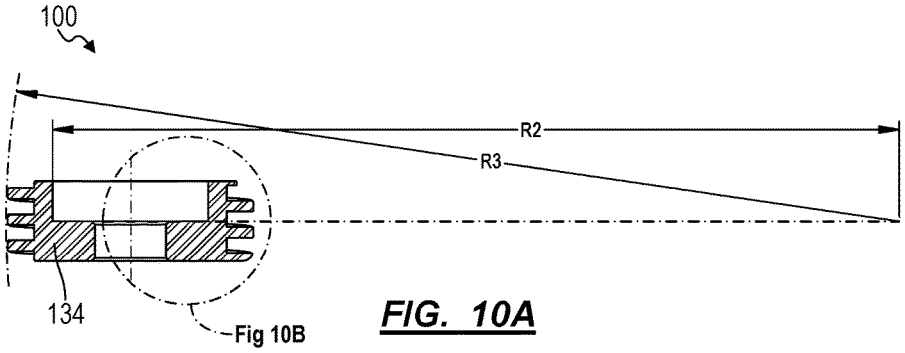
FIGS. 10A, 10B, and 10C are a schematic representation of one variation of the system.
Figure 10B:
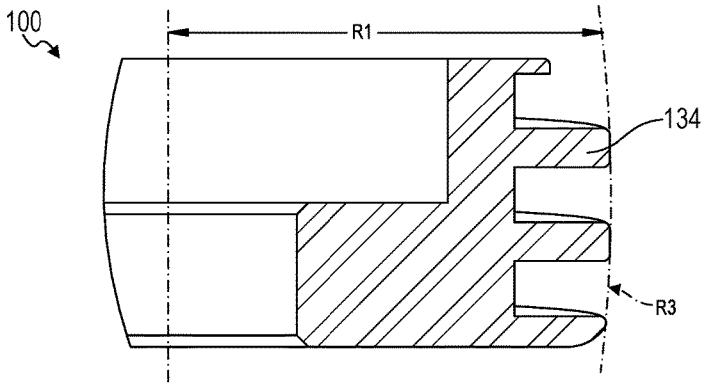
Figure 10C:
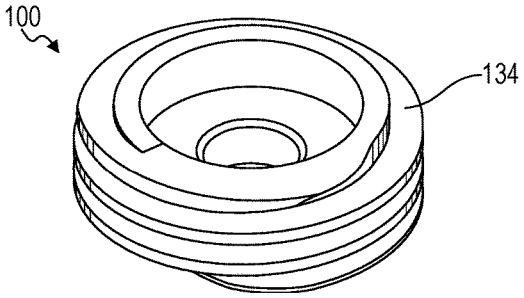
Figure 11:
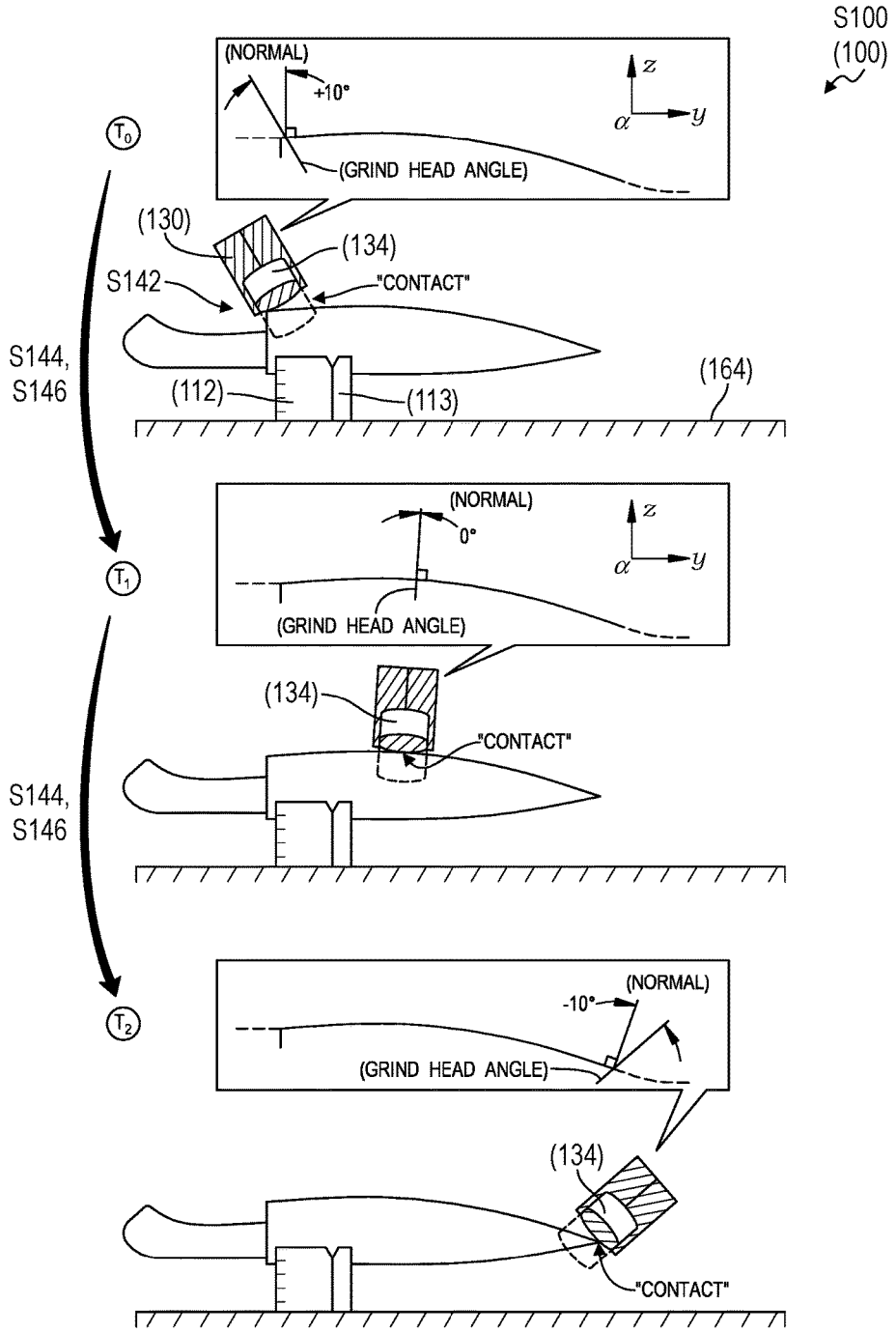
FIG. 11 is a flowchart representation of one variation of the method.

In another implementation shown in FIGS. 10A, 10B, and 10C in which the grind wheels 134 define non-linear (e.g., ellipsoidal, toroidal) grind surfaces, these interdigitated grind wheels 134 can overlap to form a non-linear apex approximating a segment of a circle perpendicular to the axles. In this implementation, the circle can define a center approximately intersecting a lateral rotational axis of the grind head 130 such that the grind wheels 134 remain in contact with a blade even as the grind head 130 is rotated about this rotational axis. For example and as described below, the controller 180 can: pitch the grind head 130 forward at a maximum fore pitch angle (e.g., +10°) at the first end of a blade profile to set the first and second grind wheels at the front of the apex in contact with the rear of blade; and pitch the grind head 130 backward as the grind head 130 moves along the blade profile in order to shift contact between the grind wheels 134 and the blade toward the back of the apex, such as with the grind head 130 pitched backward at a maximum aft pitch angle (e.g., −10°) when the grind head 130 reaches the point of the blade, as shown in FIG. 11.

3.2.4 Grind Wheel Centerline Adjustment

In one variation shown in FIGS. 5A and 5B, the grind head 130 includes a centerline adjustment mechanism configured to adjust and effect centerline distance between the first and second axles 131, 132, thereby modifying an effective angle formed at the apex of the interdigitated grind wheels 134, which in turn effects a bevel angle ground along a blade by the grind wheels 134. In particular, by decreasing the centerline distance between the first and second axles 131, 132, the grind head 130: shifts the grind wheels 134 closer together; decreases an angle of the apex formed by the grind wheels 134; and thus yields a steeper bevel on a blade when ground by the grind wheels 134 in this position. Conversely, by increasing the centerline distance between the first and second axles 131, 132, the grind head 130: shifts the grind wheels 134 further apart; increases an angle of the apex formed by the grind wheels 134; and thus yields a shallow bevel on a blade when ground by the grind wheels 134 in this position. For example, the controller 180 can: set the grind wheels 134 at a relatively short centerline distance before grinding a main cutting edge along a blade (e.g., to form an 18° bevel on each side of the blade) during a first grind cycle; and then set the grind wheels 134 at a greater centerline distance before grinding a micro-bevel along the blade (e.g., to form a short 22° bevel on each side of the blade) during a final grind cycle for the blade.

In one implementation, the first axle 131 is fixed inside the grind head 130, and the second axle 132 is mounted to a free end of an arm configured to pivot inside the grind head 130 and to locate the second axle 132 approximately vertically aligned and laterally offset from the first axle 131. In this implementation, the grind head 130 further includes: a cam follower 137 mounted to or integrated into the arm; a cam 136 adjacent the cam follower 137; a centerline adjustment actuator 135 (e.g., a linear actuator, a gearhead motor and a lead screw 117) configured to shift the cam 136 relative to the cam follower 137; and a centerline adjustment spring configured to bias the arm toward the cam 136 in order to maintain the cam follower 137 in contact with the cam 136. Thus, with the cam 136 set in a first, fully-retracted position by the centerline adjustment actuator 135, the spring can drive the arm outwardly to maintain contact between the cam follower 137 and the cam 136, thereby maximizing the centerline distance between the first and second axles 131, 132 and maximizing an angle formed at the apex of the interdigitated grind wheels 134. However, as the centerline adjustment actuator 135 moves the cam 136 toward a second, fully-advanced position, the cam follower 137 can run along the cam 136, thereby: driving the free end of the arm inwardly toward the first axle 131; compressing the spring; decreasing the centerline distance between the first and second axles 131, 132; and thus reducing an angle formed at the apex of the interdigitated grind wheels 134.

3.2.5 Grind Head Housing

The grind head 130 can also include a grind head 130 housing enclosing the grind wheels 134, the centerline adjustment mechanism, and the grind actuator 138. The grind head 130 housing can also define a wheel opening adjacent the apex formed by the grind wheels 134, a vacuum port, and an internal manifold configured to direct air from the wheel opening to the vacuum port.

In one variation, the grind head 130 also includes a set of brushes 139 mounted to the grind head 130 housing, extending across the wheel opening toward (or up to) the grind wheels 134, and configured to catch particulate ground from an edge of a blade before the vacuum unit 190—coupled to the vacuum port—draws a vacuum on the vacuum port to pull this particulate through the manifold and into a collection canister.

3.3 Scanner

Figure 4:
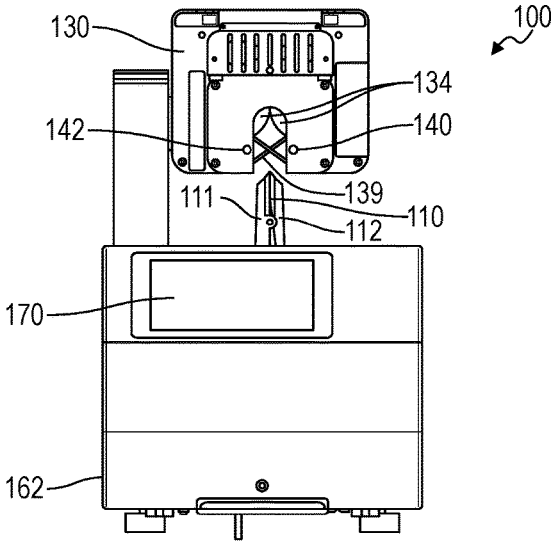
FIG. 4 is a schematic representation of one variation of the system.

As shown in FIGS. 4 and 7, the blade sensor 140 is mounted to or integrated into the grind head 130 and configured to scan the blade during a scan cycle. The controller 180 can then read data by the blade sensor 140 during a scan cycle to detect an edge of a blade occupying the vice 110 and to derive a blade profile for this blade.

In one implementation, the blade sensor 140 includes a line scan camera mounted to the grind head 130, laterally offset from the effective centerline of the grind head 130 (i.e., the apex of the grind wheels 134), and facing laterally across the grind head 130. For example, the line scan camera can include a single column of pixels and can be configured to output one-pixel-wide, many-pixel-tall images of a side of a blade—mounted in the vice 110—as the grind head 130 is scanned along the blade. In particular, in this example: the line scan camera can be arranged on the grind head 130: longitudinally offset ahead of the grind wheels 134; with the column of pixels parallel to a vertical axis of the grind head 130 (e.g., perpendicular to the rotational axes of the grind wheels 134); and with a vertical center of the field of view of the line scan camera offset below the apex formed by the grind wheels 134. Thus, during a scan cycle, the controller 180 can implement closed-loop controls to shift the grind head 130 vertically relative to the vice 110 in order to maintain the detected edge of the blade within the vertical center of the field of view of the line scan camera while scanning the grind head 130 longitudinally along the length of a blade—mounted in the vice 110—thereby maintaining the apex of the grind wheels 134 offset vertically above the edge of the blade and thus preventing collision between the grind wheels 134 and the blade during the scan cycle.

In the foregoing implementation, the grind head 130 (or the vice 110) can be mounted to a longitudinal linear slide configured to locate and constrain the grind head 130 relative to the vice 110 in five degrees of freedom while enabling the grind head 130 to translate longitudinally toward and away from the vice 110. In this implementation, the longitudinal linear slide can include a position sensor—such as in the form of a linear or rotary optical encoder—configured to output signals representing the absolute position or changes in relative position of the grind head 130 along the longitudinal linear slide. During a scan cycle, the controller 180 can thus trigger the line scan camera to record a columnar image at discrete, preset positions of the grind along the longitudinal linear slide, such as at 50-micron longitudinal steps. The controller 180 can pair each columnar image output by the line scan camera during the scan cycle with a longitudinal position and a vertical position of the grind head 130—such as relative to the vice 110—at the time the columnar image was recorded. The controller 180 can then assemble these columnar images—based on the longitudinal and vertical grind head 130 positions paired with these columnar images—to construct a composite 2D image of the blade. The controller 180 can then implement thresholding, computer vision, and/or other techniques to identify pixels in this composite 2D image that represent the edge of the blade and then extract a blade profile of the blade from these pixels, as described below.

In this implementation, the grind head 130 housing can define a light-absorptive surface (e.g., a matte black surface)—configured to absorb electromagnetic radiation within a range of frequencies detected by the blade sensor 140—facing and in the field of view of the line scan camera. The system 100 can also include a light emitter (e.g., the light projector 142 described below) configured to project light toward a segment of a blade—mounted in the vice 110—in the field of view of the optical sensor. Thus, light output by the light emitter and incident on a segment of the blade may be reflected by a (metallic) blade back toward the line scan camera, whereas relatively little of this light incident on the light-absorptive surface may reflect back to the line scan camera such that an edge of this segment of the blade may be distinguishable by the controller 180, such as via simple thresholding.

In another implementation, the blade sensor 140 includes a two-dimensional monochromatic, grayscale, or color camera similarly arranged on the grind head 130 and defining a field of view facing laterally across the grind head 130 below and ahead of the wheel opening. In this implementation, the controller 180 can trigger the 2D camera to record multi-pixel-wide multi-pixel tall images at longer longitudinal intervals during a scan cycle, can tag these 2D images with longitudinal and vertical positions of the grind head 130 at times that these 2D images were recorded, and can then assemble these 2D images—based on the longitudinal and vertical grind head 130 positions paired with these 2D images—into a composite 2D image of a blade currently occupying the vice 110.

In yet another implementation, the blade sensor 140 includes a contact probe configured to contact the edge of the blade, to run along the edge of the blade, and to measure a vertical offset distance between the grind head 130 and the edge of the blade. For example, in this implementation, the blade sensor 140 can include a contact probe running on a vertical linear slide and including a rolling element on its probe end. During a scan cycle, the controller 180 can: release the contact probe downward from the grind head 130 to contact the upwardly-facing edge of the blade; record vertical positions of the contact probe on the vertical linear slide while driving the grind head 130 longitudinally along the length of the blade; and then recombine vertical positions of the contact probe and concurrent vertical and longitudinal positions of the grind head 130 into a 2D profile of the edge of the blade.

However, the blade sensor 140 can include an optical sensor, contact sensor, or other sensor of any other type configured to output data representing or capturing an edge of a blade—loaded into the vice 110—during a scan cycle.

In one variation, the blade sensor 140 is arranged remotely from the grind head 130, such as on a sled offset laterally from the vice 110 and configured to translate longitudinally to scan the blade sensor 140 along the blade separately from the grind head 130. Alternatively, the blade sensor 140 can include a 2D camera or other optical sensor, can be fixedly mounted to the chassis 160 relative to the vice 110, and can record an image of the full length of a blade set in the vice 110; the controller 180 can then implement methods and techniques described below to extract a blade profile from this singular image of the blade. Yet alternatively, the system 100 can include multiple blade sensors arranged along a length of the chassis; and the controller 180 can stitch images recoded by these blade sensors into one composite image of a blade—set in the vice 110—based on known relative positions of these blade sensors and then extract a blade profile from this composite image.

3.4 Light Projector

In one variation shown in FIG. 4, the system 100 further includes a light projector 142 configured to project a linear beam of light parallel to and substantially aligned with the columnar field of view of the blade scanner.

In one implementation, the light projector 142 includes a laser line generator arranged in the grind head 130 ahead of the wheel opening and facing downward toward the vice 110. Generally, when active, the light projector 142 can project a column of light spreading downward and laterally across a segment of a blade—clamped in the vice 110—to indicate a segment of the blade currently in the field of view of the blade sensor 140. For example, the light projector 142 can be configured to project a linear beam of light: downward from the grind head 130 toward the blade; and longitudinally aligned with the columnar field of view of the blade sensor 140.

As described below, the controller 180 can prompt a user—via the user interface 170—to manually adjust the longitudinal position of the grind head 130 relative to the vice 110 to align the column of light output by the light projector to the rearmost segment of a sharpened edge of the blade, thereby: defining a start position for scanning the blade during a subsequent scan cycle; locating a first end of a blade profile calculated for the blade; and defining a location of initial contact between the grind wheels 134 and the rear of the blade during a subsequent grind cycle.

Alternatively, the light projector 142 can project a dot laterally across the grind head 130 near the blade sensor 140 toward a side of a blade located in the vice 110. Yet alternatively, the light projector 142 can project a dot vertically downward from the grind head 130 along the vertical centerline of the grind head 130 to illuminate a segment of the edge of the blade in the field of view of the blade sensor 140.

In one variation, rather than a light projector 142, the system 100 includes a physical pointer (or "flag") extending from the grind head 130, aligned with the field of view of the blade sensor 140, and configured to physically indicate a plane coincident the field of view of the blade sensor 140.

However, the light projector 142 can include any other type and format of optical element configured to visually indicate the field of view of the blade sensor 140. The system 100 can additionally or alternatively include a physical point of any other geometry configured to visually indicate the field of view of the blade sensor 140.

3.5 Chassis and Actuators

As shown in FIG. 3, the system 100 also includes a set of primary actuators 150 configured to move the grind head 130 and the vice 110 relative to one another, including: linearly along a longitudinal (or "y") axis; linearly along a vertical (or "z") axis; and rotationally about a pitch (or "a") axis. For example, the system 100 can include: a first electromagnetic servo motor coupled to a longitudinal linear slide defining a translational degree of freedom along the longitudinal axis; a second electromagnetic servo motor coupled to a vertical linear slide defining a translational degree of freedom along the vertical axis; and a third electromagnetic servo motor coupled to a pivot defining a rotational degree of freedom along the pitch axis. The controller 180 can thus serve commands to these servo motors to adjust the relative longitudinal, vertical, and pitch positions of the grind head 130 relative to the vice 110 and read angular or linear positions from these servo motors.

The system 100 further includes a chassis 160 configured to locate the longitudinal linear slide, the vertical linear slide, and/or the pivot. In one implementation, the vice block 122 is mounted to the vertical linear slide, and a z-axis actuator 154 coupled to the vertical linear slide moves the vice block 122—and therefore the first and second vice jaws 111, 112—along the vertical axis responsive to commands received from the controller 180. In this implementation, the longitudinal linear slide is laterally offset from the effective longitudinal centerline of the vice 110 and the grind head 130; the system 100 further includes a grind head 130 block mounted to the longitudinal linear slide; and a y-axis actuator 152 coupled to the longitudinal linear slide moves the grind head 130 block along the longitudinal axis responsive to commands received from the controller 180. Furthermore, in this implementation, the grind head 130 is mounted to the grind head 130 block and is configured to rotate about the pitch axis relative to the grind head 130 block; an a-axis actuator 156—such as arranged in the grind head 130 or in the grind head 130 block—pitches the grind head 130 relative to the grind head 130 block responsive to commands received from the controller 180.

The system 100 is described herein with the primary actuators 150 in the foregoing configuration. However, the primary actuators 150 can be arranged in any other configuration to move the grind head 130 and the vice 110 relative to one another along the longitudinal axis, along the vertical axis, and about the pitch axis. For example, in an alternative configuration, the vice block 122 can be rigidly mounted to the chassis 160 with longitudinal, lateral, and/or vertical compliance mechanisms in the vice 110 locating the first vice jaw 111 within the system 100 with some longitudinal, lateral, and vertical compliance. In this alternative configuration: the vertical linear slide can be mounted to the longitudinal linear slide; the grind head 130 block can be mounted to the vertical linear slide; and the grind head 130 can be pivotably coupled to the grind head 130 block. The y-axis actuator 152 can thus act on the longitudinal linear slide to move the grind head 130 longitudinally; the z-axis actuator 154 can thus act on the vertical linear slide to move the grind head 130 vertically; and the a-axis actuator 156 can act on the grind had to set a pitch angle of the grind had relative to the vice 110.

However, the primary actuators 150, longitudinal linear slide, vertical linear slide, and/or pivot can be arranged in any other configuration and can include any other actuators, mechanical elements, and/or sensors of any other types.

3.6 Enclosure

As shown in FIG. 2, the system 100 can further include: an opaque lower enclosure 162; and a grind bed 164 cooperating with the loser enclosure to enclose the controller 180, a lower section of the vice 110, a power supply, the chassis 160, the y-axis actuator 152, and/or the z-axis actuator 154, etc. An upper section of the vice 110 and the grind head 130 can be located above the grind bed 164; and the system 100 can further include a cover 166 arranged over the grind bed 164, enclosing the jaws of the vice 110 and the grind head 130, and formed in a transparent or translucent material to enable a user to view actuation of the vice 110 and grind head 130 during a scan and grind cycle. The cover 166 can also define a knife window 168 (i.e., an opening) at the front of the system 100 and configured to receive a knife for insertion into the vice 110. For example, a user may grasp the handle of a knife, insert the knife point-first through the knife window 168, locate the spine of the knife in the vice 110 and against the vice stop 114, push the handle fully forward to locate the bolster of the knife in contact with the front of the vice 110, and then release the knife with the blade of the knife now retained by a magnetic element in the vice 110. The controller 180 can then trigger the vice actuator 120 to close the vice 110 to clamp the blade, execute a scan cycle, and then execute one or more grind cycles. Upon conclusion of a last grind cycle and once the controller 180 triggers the vice actuator 120 to open the vice 110 to release the blade, the user can reach through the knife opening to grasp the handle of the knife and to then retract the knife out of the system 100.

3.7 Vacuum Unit

In one variation shown in FIGS. 2 and 3, the system 100 also includes a vacuum unit 190 arranged inside the enclosure, fluidly coupled to the vacuum port on the grind head 130 via a vacuum duct, and configured to draw particulate removed from a blade by the grind wheel through the manifold, through the vacuum duct, and into a waste container located within the lower enclosure 162.

3.8 User Interface

As shown in FIG. 2, the system 100 can further include a user interface 170 configured to serve prompts and/or to indicate a state of the system 100 to a user. In one implementation, the user interface 170 includes a touchscreen arranged near the front of the system 100 and below the knife window 168. The touchscreen can thus render instructions, prompts, and virtual inputs for a user during a scan cycle and a grind cycle for a knife. Alternatively, the user interface 170 can include a digital or analog display and separate digital or analog input regions. However, the user interface 170 can include a display, digital input regions, and/or analog input regions of any other type and in any other format.

3.9 Controller

As shown in FIGS. 2 and 3, the system 100 further includes a controller 180 configured to read sensor data from sensors throughout the system 100 and to control various actuators within the system 100 to execute scan and grind cycles. Generally, the controller 180 can be arranged inside the lower enclosure 162 and configured to execute scan cycles and grind cycles to sharpen knives according to Blocks of the method S100, as described below.

4. Example User Experience

In one example implementation, when the system 100 is idle, the touchscreen renders a lock screen with a virtual ten-digit touchpad. When a user enters a passcode (e.g., a four-digital numerical passcode) onto the virtual ten-digit touchpad, the controller 180 can unlock the system 100 and trigger the touchscreen to render a first pre-scan frame including a command to place a knife in the vice 110 and a virtual "clamp" button to trigger the vice 110 to close. Once the user selects the virtual clamp button, the controller 180 can: actuate the vice actuator 120 to close the vice 110 until the optical break sensor 119 indicates that the vice 110 has clamped the blade with a target clamping force; trigger the z-axis actuator 154 to lower the vice 110 to a low position; trigger the y-axis to drive the grind head 130 forward to an initial longitudinal position over the vice 110; and trigger the a-axis to set the grind head 130 at a pitch angle of 0° (i.e., with the axes of the grind wheels 134 horizontal and parallel to the vice no). With the grind head 130 and the vice 110 in this initial scan position, the controller 180 can then: activate the light beam to project a columnar beam of light toward the blade; and update the touchscreen to render a second pre-scan frame including a virtual "up" button to move the grind head 130 longitudinally forward, a virtual "down" button to move the grind head 130 longitudinally aft, a virtual start button, a command to move the grind head 130 to align the columnar beam of light with the rear edge of the blade by manipulating the virtual up and down buttons, and a command to confirm a current longitudinal position of the grind head 130 as a start position by selecting the virtual start button. The controller 180 can then return commands to the y-axis actuator 152 to move the grind head 130 fore and/or aft responsive to selections of the virtual up and down buttons by the user.

In response to the user selecting the virtual start button, the controller 180 can: execute a scan cycle to scan the grind head 130 longitudinally along a length of the blade, record a series of columnar images output by the blade sensor 140, compile these columnar images into a 2D image of the blade, and extract a blade profile—in machine coordinates—from the 2D image; and then execute one or more grind cycles to sweep the apex formed by the grind wheels 134 along and parallel to the blade profile of the blade while the grind actuator 138 is active. Upon conclusion of the last grind cycle, the controller 180 can: trigger the y-axis to drive the grind head 130 backward to a longitudinal end position remote from the vice 110; trigger the a-axis to return the grind head 130 to a pitch angle of 0°; trigger the z-axis actuator 154 to raise the vice 110 to an initial position in which the knife is substantially aligned with the knife window 168; trigger the vice actuator 120 to open the vice 110; and update the display to render a post-grind frame including a prompt to manually retrieve the knife from the knife window 168. While waiting for the user to retrieve the knife, magnetic elements in the vice 110 can magnetically couple to and retain the blade.

5. Knife Loading

As shown in FIGS. 1A and 7, Block S110 of the method S100 recites receiving a knife at a vice. In one implementation, in Block S110, the vice 110 can receive the blade of a knife—inserted manually by a user through the knife window 168 of the cover 166—with a spine of the blade facing downward toward a vice stop 114 within the vice 110 and with an edge of the blade facing upwardly from the vice 110. Upon receipt of a command from a user via the user interface 170, the controller 180 can then trigger the vice actuator 120 to close the vice 110, thereby clamping the blade proximal its spine and adjacent a bolster of the knife with a tip of the blade cantilevered off of the vice 110 toward the longitudinal end position of the system 100. Therefore, in Block S110, the controller 180 can: trigger the vice actuator 120—coupled to the vice 110—to clamp the jaws of the vice against the blade responsive to manual input at the user interface 170; later, the controller 180 can trigger the vice actuator 120 to release jaws of the vice 110 responsive to conclusion of a grind cycle, and magnetic elements in the vice 110 can retain the blade within the vice 110 once the jaws of the vice 110 release the blade and before the user removes the knife from the system 100 via the knife window 168.

Alternatively, a user may manually close the vice 110 onto the blade of a knife, as described above.

6. Scan Cycle

As shown in FIGS. 1A and 7, during a scan cycle, the controller 180 can: advance the grind head 130, relative to the vice 110, to an initial longitudinal position proximal the vice 110 in Block S120; and then longitudinally retract the grind head 130, relative to the vice 110, from proximal the initial longitudinal position toward a longitudinal end position of the system 100 in Block S122. Furthermore, as the grind head 130 retracts from proximal the initial longitudinal position toward the longitudinal end position, the controller 180 can record a sequence of vertical positions of segments of an edge of a blade of the knife based on outputs of the blade sensor 140 in Block S124. Generally, in Blocks S120, S122, and S124, the controller 180 can scan the blade sensor 140 along the length of the blade to collect data representative of the geometry of the blade before bringing the grind wheels 134 into contact with the edge of the blade.

6.1 Initial Vertical Cycle Position

In one implementation, at the conclusion of a last grind cycle for a knife, the controller 180 can trigger the primary actuators 150 to: move the grind head 130 back to the longitudinal end position remote from the vice 110; lower the vice 110 to an initial vertical position; and set the grind head 130 at a nominal pitch angle substantially parallel to the vice 110. The controller 180 can maintain the grind head 130 and the vice 110 in these positions while the system 100 is idle and awaiting insertion of a next knife. When a next knife is inserted into the vice 110 and the controller 180 closes the vice 110 and initiates a new scan cycle (e.g., responsive to receipt of confirmation entered at the user interface 170), the controller 180 can: trigger the y-axis actuator 152 to drive the grind head 130 forward to an initial longitudinal position adjacent (e.g., over) the vice 110, such as to locate the rear edge of the vice 110 in or near the field of view of the blade sensor 140; trigger the blade sensor 140 to record a sequence of images (e.g., at a rate of 50 Hz) while triggering the z-axis actuator 154 to raise the vice 110; analyze this sequence of images for a feature indicative of an edge of the blade (e.g., based on a top-down change in grayscale or binary black-and-white values detected in a columnar image output by the blade sensor 140, as described below); and then trigger the vice 110 to cease raising the vice 110 once the detected edge of the blade reaches a target position in the field of view of the blade sensor 140. For example, the controller 180 can trigger the z-axis actuator 154 to raise the vice 110 until the detected edge of the blade approximately aligns with a vertical center of the field of view of the blade; later, during the scan cycle, the controller 180 can implement closed-loop controls to maintain the detected edge of the blade centered in the columnar field of view of the blade sensor 140, as described below. The controller 180 can then store this vertical position of the vice 110 as an initial vertical position for the upcoming scan cycle.

6.2 Initial Longitudinal Cycle Position

In one implementation, the controller 180 prompts the user—through the user interface 170—to indicate a longitudinal position of the rear of the blade of the knife (i.e., a rearmost sharpened edge of the blade, a rearmost position of the blade to be contacted by the grind wheels 134 during a grind cycle). For example, once the controller 180 determines the initial vertical position for the upcoming scan cycle, the controller 180 can: trigger the light projector 142 in the grind head 130 to project a light beam toward the vice 110, as described above; and serve a prompt—via the user interface 170—to manually shift the grind head 130, longitudinally relative to the vice 110, to align the light beam to a rear of the edge of the blade. In this example, the user interface 170 can render fore and aft virtual buttons, and the controller 180 can trigger the y-axis actuator 152 to index fore and aft responsive to selections of the fore and aft virtual buttons at the user interface 170. The controller 180 can then store a current longitudinal position of the grind head 130 as a longitudinal start position of the grind head 130 responsive to receipt of confirmation of the grind head 130 position at the user interface 170.

Alternatively, responsive to receipt of confirmation of the grind head 130 position at the user interface 170, the controller 180 can autonomously verify this longitudinal start position. In one implementation shown in FIG. 1A, in response to receipt of confirmation of alignment between the light beam and the rear of the edge of the blade at the user interface 170, the controller 180: stores the current longitudinal position of the grind head 130 relative to the vice 110 as a longitudinal start position; and retracts the grind head 130, relative to the vice 110, from the longitudinal start position toward the longitudinal end position of the system 100 by a preset offset distance (e.g., twenty millimeters). Then, while advancing the grind head 130, relative to the vice 110, back toward the initial longitudinal position, the controller 180: records a sequence of pre-scan images output by the blade sensor 140; extracts a pre-scan sequence of vertical positions of segments of the edge of the blade from this sequence of pre-scan images, such as according to methods and techniques described below; detects and interprets a feature in the pre-scan sequence of vertical positions as a true rear of the edge of the blade; and then realigns the longitudinal start position to this true rear of the edge of the blade. For example, the controller 180 can: detect a discontinuity—in this pre-scan sequence of vertical positions—that represents one of a choil, a plunge line, a ricasso, and a corner at the rear of the edge of the blade; identifying this discontinuity as the true rear of the edge of the blade; and reset the longitudinal start position at this true rear of the edge of the blade.

However, the controller 180 can implement any other method and technique to set the vertical and/or longitudinal start positions for the upcoming scan cycle.

6.3 Longitudinal Scan

During the subsequent scan cycle, the controller 180 can: trigger the y-axis actuator 152 to retract the grind head 130 from this longitudinal start position toward the longitudinal end position; record a sequence of scan images output by the blade sensor 140 while moving the grind head 130 from the longitudinal start position toward the longitudinal end position; and extract a sequence of vertical positions of the edge of the blade from this sequence of scan images, as shown in FIGS. 1A and 7.

In one implementation, the controller 180 implements closed-loop control to maintain the detected edge of the blade within the field of view of the blade sensor 140, such as centered within the field of view of the blade sensor 140, as shown in FIG. 1A. For example, the controller 180 can retract the grind head 130 along a series of longitudinal waypoints between the initial longitudinal position and the longitudinal end position. In this example, when the grind head 130 occupies each successful waypoint in this series, the controller 180 can: detect a vertical height of a segment of the edge of the blade in the field of view of the blade sensor 140 (i.e., in a columnar image recorded by the blade sensor 140 while the grind head 130 occupied this waypoint); calculate a vertical position of the segment of the edge of the blade in machine coordinates based on a combination of the vertical height of this section of the edge in the field of view of the blade sensor 140 (e.g., the vertical position of a pixel intersection the columnar image at which the edge of the blade was detected) and a concurrent vertical position of the vice 110 relative to the grind head 130; and store this vertical position of the segment of the edge of the blade—in machine coordinates—with a concurrent longitudinal position of the grind head 130 relative to the vice 110. In this example, the controller 180 can also trigger the z-axis actuator 154 to adjust a vertical position of the vice 110, relative to the grind head 130, to approximately center the segment of the edge of the blade in the field of view of the sensor (e.g., proportional to pixel distance between a pixel representing the detected edge of the blade and a pixel representing the center of the field of view of the blade sensor 140) before or while triggering the y-axis actuator 152 to drive the grind head 130 to the next waypoint in the series.

In one implementation, the blade sensor 140 records and outputs columnar (e.g., one-pixel wide) grayscale images, as described below and as shown in FIG. 7. In this implementation, upon receipt of a grayscale columnar image from the blade sensor 140, the controller 180 can scan the pixels in the columnar image—from the top down—for a next pixel containing a grayscale value significantly greater than an average of grayscale values of pixels in the grayscale columnar image above this next pixel. Upon detecting a particular pixel that exhibits a grayscale value significantly greater than other pixels above it in the grayscale columnar image, the controller 180 can: identify this particular pixel as representing the edge of a segment of the blade in the field of view of the blade sensor 140 at a particular time this grayscale columnar image was recorded; extract a vertical pixel position of this particular pixel in the column of pixels in the columnar image; transform this vertical pixel position into a vertical machine position of the edge of this segment of the blade relative to the grind head 130 at the particular time based on a known position of the blade sensor 140 on the grind head 130 and known intrinsic properties of the blade sensor 140; and read or access a longitudinal position of the grind head 130 and a vertical position of the vice 110 at this particular time. The controller 180 can then write a point representing the edge of this segment of the blade to a y-z plot, including: defining the point at a position along a y-axis of the plot based on the longitudinal position of the grind head 130 in machine coordinates at this particular time; and defining the point at a position along a z-axis of the plot based on a combination (e.g., a sum) of the vertical position of the vice 110 and the vertical machine position of the edge of the segment of the blade relative to the grind head 130 at the particular time.

In this foregoing implementation, the computer system can also: calculate a difference between the vertical pixel position and a center vertical pixel in the blade sensor 140; transform this difference into an offset vertical distance in machine coordinates based on known intrinsic properties of the blade sensor 140; and drive the z-axis actuator 154 to raise or lower the vice 110 by this offset vertical distance.

In another implementation, the controller 180 can: implement a preset grayscale threshold (e.g., a threshold value of "100" for a 256-bit grayscale columnar image) to convert grayscale pixels in the grayscale columnar image output by the blade sensor 140 at the particular time into a binary (e.g., a black and white) image; scan pixels in the binary image from the top down for a transition from a series of black pixels to a first white pixel in a series of white pixels (e.g., a contiguous series of a minimum number of white pixels); store this first white pixel as a vertical pixel position of the edge of a segment of the blade in the field of view of the blade sensor 140 at the time the original grayscale columnar image was recorded by the blade sensor 140; and then implement methods and techniques similar to those described above to handle this vertical pixel position.

In the foregoing implementation, the controller 180 can also: feed a position of a pixel—in a preceding columnar image recorded by the blade sensor 140—identified as representing an edge of a preceding segment of the blade forward to isolate a subset of pixels around the same pixel position in a next columnar image output by the blade sensor 140; preferentially scan this subset of pixels for a large change in grayscale value or binary value across adjacent pixels; and then isolate a pixel representing such substantive change in value as the edge of the segment of the blade depicted in the columnar image.

The controller 180 can repeat the foregoing process(s) over time during the scan cycle. For example, the blade sensor 140 can record and output timestamped columnar frames at static frame rates (e.g., 100 Hz); and the controller 180 can read relative longitudinal and vertical positions of the grind head 130 and the vice 110 at the same or greater rate. Upon receipt of a columnar image, the controller 180 can: detect and extract a vertical position of an edge of the blade represented in this columnar image; convert this vertical position of the edge in the field of view of the blade sensor 140 and the concurrent vertical position of the vice 110 to a vertical position of the edge of the blade in machine coordinates; store this vertical position in machine coordinates with the concurrent longitudinal position of the grind head 130; and repeat this process for each subsequent columnar image recorded by the blade sensor 140 during the scan cycle. Alternatively, the controller 180 can: drive the y-axis actuator 152 to move the grind head 130 through a series of waypoints (e.g., offset longitudinally by 500 microns); trigger the blade sensor 140 to record and output a columnar image responsive to the grind head 130 entering each successive waypoint; and repeat the foregoing process for a columnar image recorded at each waypoint to generate a set of vertical positions along the edge of the blade with corresponding longitudinal positions of the grind head 130, all in machine coordinates.

Furthermore, the controller 180 can determine that the field of view of the blade sensor 140 has passed the point of the blade based on absence of grayscale or binary pixels that meet value changes or thresholds described above. Upon determining that the blade sensor 140 has passed the point of the blade, the controller 180 can terminate the scan cycle, calculate the blade profile of the blade in Block S130, and return the grind head 130 and vice to an initial grind position before initiating the first grind cycle.

The controller 180 can additionally or alternatively: store original columnar images output by the blade sensor 140—such as tagged with timestamps, longitudinal positions of the grind head 130, vertical positions of the vice 110, and/or pitch positions of the grind head 130, etc. at times these columnar images were recorded—during the scan cycle; compile these columnar images into a 2D composite image of the blade; implement edge detection, thresholding, and/or other computer vision techniques to detect the edge of the blade in this 2D composite image; and then extract longitudinal and vertical positions of points in this 2D composite image—such as in machine or pixel coordinates—representing the edge of the blade.

However, the controller 180 can: implement any other method or techniques to detect the edge of a segment of a blade depicted in an image recorded by the blade sensor 140; implement any other closed-loop controls to maintain the edge of the blade at the center of or otherwise within the field of view of the blade sensor 140; store images output by the blade sensor 140 or blade edge positions calculated therefrom in any other format; and/or implement any other method or technique to detect the tip of the blade or to otherwise trigger termination of the scan cycle.

7. Blade Profile

Block S130 of the method S100 recites calculating a blade profile for the knife based on the sequence of vertical positions. Generally, in Block S130, the system 100 can transform vertical and longitudinal coordinates of the detected edge of the blade—such as stored in machine and/or pixel coordinates—into a 2D profile representing the edge of the blade, as shown in FIG. 7.

In one implementation, the controller 180 records a sequence of vertical positions of segments of the edge of the blade paired with concurrent longitudinal positions of the grind head 130 relative to the vice 110 in Block S124 as the grind head 130 retracts from proximal the initial longitudinal position toward the longitudinal end position, as described above. The controller 180 then: calculates a polynomial function relating longitudinal positions and vertical positions—in this sequence of vertical positions—in a machine coordinate system; and stores this polynomial function as the blade profile. Alternatively, the controller 180 can extract a sequence of vertical and longitudinal waypoints along the blade directly from data collected in Block S124 and store this sequence of vertical and longitudinal waypoints as the blade profile.

The controller 180 can also shift the blade profile—in machine coordinates—vertically and/or longitudinally based on a known offset between the blade sensor 140 and the apex formed by the grind wheels 134 (or other reference origin on the grind head 130). In the variation described below in which the controller 180 triggers the centerline adjustment actuator 135 to shift the centerline distances between the grind wheels 134 to achieve different bevel angles during successive grind cycles, the controller 180 can similarly calculate one blade profile for each grind cycle based on an offset between the blade sensor 140 and the apex formed by the grind wheels 134 at various centerline distances between the grind wheels 134.

However, the controller 180 can extract or define the blade profile for the blade in any other way in Block S130.

7.1 Start/End Conditions

In one variation shown in FIG. 7, the controller 180 can also add a lead-in arc to the leading end of the blade in order to define a geometry over which the system 100 sweeps the grind head 130 as the grind wheels 134 come into contact with the rear edge of the blade. Similarly, the controller 180 can also: detect a point of the blade at a terminus of this sequence of vertical positions; and extend the blade profile by a lead-out distance past a longitudinal position of the point of the blade, thereby appending blade profile with a lead-out arc over which the system 100 may sweep the grind head 130 to fully disengage the grind wheels 134 from the point of the blade.

7.2 Blade Condition Check

In one variation, the controller 180 estimates a condition of the blade—such as presence of chips, defects, or other damage along the edge of the blade—from the blade profile or from data collected by the controller 180 during the scan cycle. The controller 180 can then specify a number of "roughing" grind cycles with the grind wheels 134 set at a minimum centerline distance) to remove any damage from the blade before executing one or more finishing passes (e.g., to remove burrs and/or to create a micro-bevel) along the blade. In one example, the controller 180: calculates a variance or error between the sequence of vertical positions representing the edge of the blade and the blade profile; calculates a target number of grind cycles proportional to this variance or error; and then executes this target number of instances of the grind cycle, as described below.

In another example, the controller 180 can: scan the sequence of vertical positions representing the edge of the blade for a discontinuity, which may represent a chip; smooth the blade profile across this discontinuity; and estimate a number of grind cycles needed to flatten the edge of the blade and thus remove this discontinuity. The controller 180 can additionally or alternatively set a speed of the grind wheels 134 sufficient to remove this discontinuity in one or a small number of grind cycles.

However, the controller 180 can implement any other method or technique to characterize the edge of the blade and to set grind cycle parameters accordingly.

7.3 Blade Type Check

In a similar variation, the system 100 can characterize a type of the blade based on data collected during the grind cycle and then selectively accept or reject the knife accordingly. In one implementation, the controller 180 calculates a variance (or an error) of the sequence of vertical positions representing the edge of the blade from the blade profile. In this implementation, in response to the variance exceeding a threshold value, the controller 180: characterizes the blade as serrated; rejects the knife; trigger the vice actuator 120 to open the vice 110; and serves a prompt—via the user interface 170—to remove the knife from the vice 110.

In another implementation, the controller 180: calculates a Fourier transform of the detected edge of the blade; characterizes the blade as serrated if a major oscillatory component characteristic of the blade exceeds a threshold frequency (e.g., $2\pi$ per centimeter in the longitudinal dimension); and then rejects the knife accordingly.

However, the controller 180 can implement any other methods or techniques to automatically characterize the blade as straight or serrated, to accept the former, and to reject the latter. Alternatively, the user can enter—via the user interface 170—a type and condition of the blade, a preferred number of grind cycles, a set and order of bevel angles to grind along the blade, etc.

8. Grind Cycle

The method S100 further includes, during a grind cycle: advancing the grind head 130, relative to the vice 110, to proximal the initial longitudinal position in Block S140; actuating a grind wheel in the grind head 130 in Block S142; longitudinally retracting the grind head 130, relative to the vice 110, from proximal the initial longitudinal position toward the longitudinal end position along the blade profile in Block S144; and, while longitudinally retracting the grind head 130, pitching the grind head 130, relative to the vice 110, to maintain an axis of the grind wheel substantially parallel to local tangents along the blade profile in Block S146. Generally, after calculating a blade profile and verifying a type of the blade, etc. the controller 180 executes a grind cycle to sharpen the blade, including: triggering the grind actuator 138 to rotate the grind wheels 134 in Block S140; and coordinating the y-, z-, and a-axis actuators 150 to sweep the grind head 130—relative to the vice 110—along the blade profile in Blocks S142 and S144, thereby engaging the rotating grind wheels 134 against the edge of the blade with substantially consistent force along the length of the blade and with the contact path of the grind wheel on the blade substantially parallel to the edge of the blade along its length, as shown in FIGS. 1B, 8, and 9.

8.1 Initial Grind Position and Grind Wheel Actuation

In one implementation, to initiate a grind cycle, the controller 180: triggers the z-axis actuator 154 to lower the vice 110 to an initial vertical position; triggers the y-axis actuator 152 to advance the grind head 130 longitudinally toward an initial longitudinal position; triggers the a-axis actuator 156 to set the grind head 130 at a pitch angle substantially parallel to a first tangent on a first end of the blade profile (i.e., adjacent the rear of the edge of the blade); activates the vacuum unit 190; and then triggers the z-axis actuator 154 to raise the vice 110 to a first vertical position defined at the first end of the blade profile, thereby locating the rear of the edge of the blade in contact with the grind wheels 134, as shown in FIG. 8.

Alternatively, the controller 180 can: coordinate the y-, z-, and a-axis actuators 150 to drive the grind head 130—relative to the vice 110—to the first end of the lead-in arc added to the grind profile; activate the grind actuator 138;

and coordinate the y-, z-, and a-axis actuators 150 to drive the grind head 130—relative to the vice 110—along this lead-in arc to engage the grind wheels 134 to the rear of the edge of the blade.

8.2 Grind Wheel Sweep

Once the grind wheels 134 are engaged with the edge of the blade, the controller 180 can: coordinate the y-, z-, and a-axis actuators 150 to sweep the grind head 130—relative to the vice 110—along the blade profile, including adjusting a pitch of the controller 180 in order to maintain the apex—formed by the grind wheels 134 and in contact with the edge of the blade—substantially parallel to the edge of the blade from the rear of the blade to the point of the blade, as shown in FIG. 9. In particular, the controller 180 can drive the a-axis actuator 156 configured to adjust a pitch of the grind head 130, drive the y-axis actuator 152 configured to move the grind head 130 longitudinally relative to the vice 110, and drive a z-axis actuator 154 configured to move the vice 110 vertically relative to the grind head 130 in order to trace a grind surface on the grind wheels 134, in contact with the blade, along the blade profile.

Upon reaching the edge of the blade profile—and sweeping the grind head 130 along a lead-out arc appended to the end of the blade profile—the controller 180 can trigger the primary actuators 150 to: return the grind head 130 and the vice 110 to the initial longitudinal and vertical positions in preparation for executing a next grind cycle; or return the grind head 130 to the longitudinal end position and lower the vice 110 in preparation for releasing the blade to the user.

9. Second Grind Cycle

In one variation shown in FIG. 1B, the controller 180 executes a second grind cycle to sweep the rotating grind wheels 134 along the blade profile, such as to: remove additional material from the edge of the blade (e.g., to remove damage or a defect from the blade); to remove a burr from the edge of the blade; or to grind a bevel of a different angle (e.g., a micro bevel) along the edge of the blade.

9.1 Speed Change

In one implementation, the controller 180 reduces the rotational speed of the grind wheels 134 and/or increases to traverse speed (or "feed rate") of the grind head 130 relative to the vice 110 over successive grind cycles in order to reduce an amount of material ground from the end of the blade and thus simulate grinding with higher-grit grinding wheels over these successive grind cycles.

For example, in Block S140, the controller 180 can actuate the grind wheel actuator to counter-rotate the grind wheels 134 at a first angular speed (e.g., 1000 rpm) during a first grind cycle in order to grind a large amount of material—and thus remove small defects—from the edge of the blade. However, this first grind cycle may produce a burr along the edge of the blade. The controller 180 can thus execute a second grind cycle, including: returning the grind head 130 to proximal the initial longitudinal position; actuating the grind wheel actuator to counter-rotate the grind wheels 134 at a second angular speed less than the first angular speed (e.g., 400 rpm); actuating the y-axis actuator 152 to longitudinally retract the grind head 130, relative to the vice 110, from proximal the initial longitudinal position toward the longitudinal end position along the blade profile; and, while longitudinally retracting the grind head 130, actuating the a-axis actuator 156 to pitch the grind head 130, relative to the vice 110, in order to maintain an axis of the grind wheel substantially parallel to local tangents along the blade profile. In particular, the controller 180 can repeat Blocks S140, S142, and S144—now at reduced grind wheel speed and/or increased longitudinal traversal speed—in order to remove the burr from the edge of the blade.

In the variation described below in which the controller 180 executes additional grind cycles to grind bevels of different geometries along the edge of the blade, the controller 180 can similarly set a rotational speed of the grind wheels 134 proportional to target depths for these bevels. For example, after grinding a primary 18° bevel two millimeters deep on each side of the blade with a grind wheel speed of 1000 rpm, the controller 180 can grind a "micro" 22° bevel 250 microns deep on each side of the blade with a grind wheel speed of 100 rpm.

However, the controller 180 can set the grind wheel speed and/or the longitudinal traversal speed of the grind head 130 for a grind cycle according to any other target grind profile or target degree of material removal from the blade.

9.2 Bevel Angle Change

In one variation, the controller 180 adjusts a centerline offset distance between the grind wheels 134 between successive grind cycles in order to achieve different bevel geometries along the length of the blade.

In one implementation, prior to driving the grind wheels 134 into contact with the rear edge of the blade and then longitudinally retracting the grind head 130 along the blade profile during a first grind cycle, the controller 180 can trigger a grind wheel adjuster to set the grind wheels 134 at a first centerline distance corresponding to a first bevel angle (e.g., to form an included angle of 36° at the apex of the grind wheels 134). After completing the first grind cycle and prior to driving the grind wheels 134 back into contact with the rear edge of the blade during a second grind cycle, the controller 180 can trigger the grind wheel adjuster to set the grind wheels 134 at a second centerline distance less than the first centerline distance and corresponding to a second bevel angle less than the first bevel angle (e.g., to form an included angle of 44° at the apex of the grind wheels 134). In this implementation, the controller 180 can also adjust the blade profile for these different grind wheel centerline distances. In particular, the apex formed by the grind wheels 134 may lower relative to the grind head 130 (and/or relative to the blade sensor 140) as the centerline distance between the grind wheels 134 decreases. The controller 180 can therefore shift the blade profile inwardly between the first and second grind cycles in order to compensate for a change in the relative position of the apex formed at the intersection of the grind wheel and to thus maintain similar forces between the grind wheels 134 and the blade over these grind cycles.

9.3 Triggers for Additional Grind Cycles

In one variation, the controller 180 executes a second scan cycle after a grind cycle in order to generate a revised grind profile for the blade, check the edge of the blade for discontinuities (which may indicate persistence of defects long the edge of the blade), and to prepare for a next grind cycle.

In one implementation, in response to completion of the grind cycle, the controller 180: triggers the y-axis actuator 152 to advance the grind head 130 to proximal the initial longitudinal position; records a second sequence of vertical positions of segments of the edge of the blade based on outputs of the blade sensor 140 while triggering the y-axis actuator 152 to longitudinally retract the grind head 130 from proximal the initial longitudinal position toward the longitudinal end position; and surveys the second sequence of vertical positions for discontinuities, as described above. Then, in response to detecting a discontinuity—in this second sequence of vertical positions—that exceeds a threshold "rework" dimension, the controller 180 can execute a second grind cycle, such according to the same (high) grind wheel speed and (slow) longitudinal traversal rate as the preceding grind cycle. However, if the controller 180 detects a discontinuity greater than a threshold reject dimension (greater than the rework dimension), the controller 180 can cease the grind cycle, trigger the vice actuator 120 to release the knife, and serve a prompt via the user interface 170 to manually correct defects along the edge of the blade.

However, if the controller 180 detects no discontinuity greater than the rework dimension, the controller 180 can: execute any remaining grind cycles designated for the blade (e.g., a "finishing" pass or micro-bevel pass); and then release the knife for manual retrieval by the user.

9.4 Ellipsoidal Grind Surfaces and Wear Reduction

In one variation described above and shown in FIGS. 10A, 10B, and 10C, the grind wheels 134 define ellipsoidal (i.e., nonlinear) grind surfaces, and the system 100 sweeps the grind head 130 over a range of pitch angles relative to the blade profile while moving the grind head 130 in order to shift contact between the blade and the grind wheels 134 along the length of the apex formed by the grind wheels 134 as the grind wheels 134 move along the length of the blade. In particular, the system 100 can vary the angle of the grind wheels 134 relative to a local tangent of the edge of the blade in order to distribute wear across the length of the grind wheels 134 and thus extend a useful "life" of the grind wheels 134.

In one implementation shown in FIG. 1*i*, when initiating a grind cycle, the controller 180 triggers the primary actuators 150: to set the grind head 130 at a first longitudinal position defined by a first end of the blade profile; and to set the grind head 130 at a start pitch angle positively angularly offset (e.g., by +10°) from a first local tangent proximal the first end of the blade profile in order to locate grind surfaces at fronts of the interdigitated grind wheels 134 in contact with a rear of the blade. Then, while retracting the grind head 130 to a second longitudinal position defined near a midpoint of the blade profile, the controller 180 can trigger the a-axis actuator 156 to sweep the grind head 130 to a center pitch angle parallel to a second local tangent on the midpoint of the blade profile (e.g., 0° or tangent to the midpoint of the blade profile) in order to locate centers of the grind surfaces of the interdigitated grind wheels 134 in contact with a midpoint of the blade. Furthermore, while retracting the grind head 130 to a third longitudinal position defined by a second end of the blade profile (e.g., near the point of the blade), the controller 180 can trigger the a-axis actuator 156 to sweep the grind head 130 to an end pitch angle negatively angularly offset (e.g., by −10°) from a third local tangent proximal the second end of the blade profile in order to locate grind surfaces at the rear of the interdigitated grind wheels 134 in contact with the tip of the blade.

Alternatively, the system 100 can vary the angle of the grind head 130 relative to a blade profile (e.g., in 1° increments) between individual grind cycles or between individual knives loaded into the system 100. However, the system 100 can implement any other method or technique to distribute wear across the length of the grind wheels 134 over time.

10. Grind Cycle Conclusion

Finally, in response to completion of a last grind cycle designated for the blade, the controller 180 can: deactivate the grind actuator 138; automatically deactivate the vacuum unit 190; trigger the z-axis actuator 154 to lower the vice 110 to the initial vertical position; trigger the y-axis actuator 152 to retract the grind head 130 to the longitudinal end position; and then trigger the vice actuator 120 to open the vice 110 and thus release the blade. The controller 180 can also update the user interface 170 to render a prompt to manually retrieve the knife via the knife window 168, as shown in FIG. 1B. However, the controller 180 can execute any other process to complete the grind cycle and return the knife to the user.

The systems and methods described herein can be embodied and/or implemented at least in part as a machine configured to receive a computer-readable medium storing computer-readable instructions. The instructions can be executed by computer-executable components integrated with the application, applet, host, server, network, website, communication service, communication interface, hardware/firmware/software elements of a user computer or mobile device, wristband, smartphone, or any suitable combination thereof. Other systems and methods of the embodiment can be embodied and/or implemented at least in part as a machine configured to receive a computer-readable medium storing computer-readable instructions. The instructions can be executed by computer-executable components integrated by computer-executable components integrated with apparatuses and networks of the type described above. The computer-readable medium can be stored on any suitable computer readable media such as RAMs, ROMs, flash memory, EEPROMs, optical devices (CD or DVD), hard drives, floppy drives, or any suitable device. The computer-executable component can be a processor but any suitable dedicated hardware device can (alternatively or additionally) execute the instructions.

As a person skilled in the art will recognize from the previous detailed description and from the figures and claims, modifications and changes can be made to the embodiments of the invention without departing from the scope of this invention as defined in the following claims.

We claim:

1. A method for automatically re-sharpening a knife comprising:

receiving a knife at a vice;

during a scan cycle:

advancing a grind head, relative to the vice, to an initial longitudinal position proximal the vice;

longitudinally retracting the grind head, relative to the vice, from proximal the initial longitudinal position toward a longitudinal end position;

as the grind head retracts from proximal the initial longitudinal position toward the longitudinal end position, recording a sequence of vertical positions of segments of an edge of a blade of the knife based on outputs of a sensor arranged in the grind head;

calculating a blade profile for the knife based on the sequence of vertical positions; and during a grind cycle:

advancing the grind head, relative to the vice, to proximal the initial longitudinal position;

actuating a grind wheel in the grind head;

longitudinally retracting the grind head, relative to the vice, from proximal the initial longitudinal position toward the longitudinal end position along the blade profile; and while longitudinally retracting the grind head, pitching the grind head, relative to the vice, to maintain an axis of the grind wheel substantially parallel to local tangents along the blade profile.

2. The method of claim 1, wherein receiving the knife comprises, at the vice:

receiving the blade of the knife at the vice with a spine of the blade facing downward toward a vice stop within the vice and with the edge of the blade facing upwardly from the vice; and clamping the blade proximal the spine and adjacent a bolster of the knife with a tip of the blade cantilevered off of the vice toward the longitudinal end position.

3. The method of claim 1:

wherein receiving the knife comprises triggering a vice actuator coupled to the vice to clamp jaws of the vice against the blade responsive to manual input at a user interface; and further comprising triggering the vice actuator to release jaws of the vice responsive to conclusion of the grind cycle, a magnetic element in the vice retaining the blade within the vice once the jaws of the vice release the blade.

4. The method of claim 1, further comprising:

at the grind head, projecting a light beam toward the vice;

at a user interface, serving a prompt to manually shift the grind head, longitudinally relative to the vice, to align the light beam to a rear of the edge of the blade;

in response to receipt of confirmation of alignment between the light beam and the rear of the edge of the blade at the user interface:

storing a current longitudinal position of the grind head relative to the vice as a longitudinal start position;

retracting the grind head, relative to the vice, from the longitudinal start position toward the longitudinal end position by a preset offset distance;

while advancing the grind head, relative to the vice, back toward the initial longitudinal position, recording a pre-scan sequence of vertical positions of segments of the edge of the blade;

interpreting a feature in the pre-scan sequence of vertical positions as a true rear of the edge of the blade; and realigning the longitudinal start position to the true rear of the edge of the blade;

wherein retracting the grind head during the scan cycle comprises retracting the grind head from the longitudinal start position toward the longitudinal end position; and wherein recording the sequence of vertical positions of the edge of the blade during the scan cycle comprises recording the sequence of vertical positions of the edge of the blade from the longitudinal start position toward the longitudinal end position.

5. The method of claim 4, wherein interpreting the feature in the pre-scan sequence of vertical positions as the true rear of the edge of the blade comprises:

detecting a discontinuity in the pre-scan sequence of vertical positions representing one of a choil, a plunge line, a ricasso, and a corner at the rear of the edge of the blade; and identifying the discontinuity as the true rear of the edge of the blade.

6. The method of claim 1:

further comprising, during the scan cycle:

lowering the vice, relative to the grind head, to an initial vertical position;

setting the grind head at a nominal pitch angle substantially parallel to the vice; and raising the vice, relative to the grind head, until an edge of the blade detected by the sensor approximately aligns with a vertical center of a field of view of the sensor, the sensor comprising a column of optical detectors;

wherein longitudinally retracting the grind head during the scan cycle comprises retracting the grind head along a series of longitudinal waypoints between the initial longitudinal position and the longitudinal end position; and wherein recording the sequence of vertical positions of segments of the edge of the blade during the scan cycle comprises, when the grind head occupies each waypoint, in the series of waypoints relative to the vice:

detecting a vertical height of a segment of the edge of the blade in the field of view of the sensor;

calculating a vertical position of the segment of the edge of the blade in machine coordinates based on a combination of the vertical height of the segment of the edge in the field of view of the sensor and a concurrent vertical position of the vice, relative to the grind head;

storing the vertical position of the segment of the edge of the blade with a concurrent longitudinal position of the grind head, relative to the vice; and adjusting a vertical position of the vice, relative to the grind head, to approximately center the segment of the edge of the blade in the field of view of the sensor.

7. The method of claim 1:

wherein actuating the grind wheel comprises actuating a grind wheel actuator to counter-rotate a pair of grind wheels, arranged in the grind head, at a first angular speed during the grind cycle;

further comprising, during a second grind cycle succeeding the grind cycle:

returning the grind head to proximal the initial longitudinal position;

actuating the grind wheel actuator to counter-rotate the pair of grind wheels at a second angular speed less than the first angular speed;

longitudinally retracting the grind head, relative to the vice, from proximal the initial longitudinal position toward the longitudinal end position along the blade profile; and while longitudinally retracting the grind head, pitching the grind head, relative to the vice, to maintain an axis of the grind wheel substantially parallel to local tangents along the blade profile.

8. The method of claim 7, further comprising:

prior to longitudinally retracting the grind head from proximal the initial longitudinal position toward the longitudinal end position along the blade profile during the grind cycle, triggering a grind wheel adjuster to set the pair of grind wheels at a first centerline distance corresponding to a first bevel angle; and prior to longitudinally retracting the grind head from proximal the initial longitudinal position toward the longitudinal end position along the blade profile during the second grind cycle, triggering the grind wheel adjuster to set the pair of grind wheels at a second centerline distance less than the first centerline distance and corresponding to a second bevel angle less than the first bevel angle.

9. The method of claim 1:

wherein actuating the grind wheel comprises actuating a grind wheel actuator to counter-rotate a pair of interdigitated grind wheels arranged in the grind head, the interdigitated grind wheels defining nonlinear grind surface profiles; and wherein longitudinally retracting the grind head and pitching the grind head during the grind cycle comprises:

with the grind head located at a first longitudinal position defined by a first end of the blade profile, setting the grind head at a start pitch angle positively angularly offset from a first local tangent proximal the first end of the blade profile to locate fore grind surfaces of the interdigitated grind wheels in contact with a rear of the blade;

while retracting the grind head to a second longitudinal position defined by a midpoint of the blade profile, sweeping the grind head to a center pitch angle parallel to a second local tangent on the midpoint of the blade profile to locate center grind surfaces of the interdigitated grind wheels in contact with a midpoint of the blade; and while retracting the grind head to a third longitudinal position defined by a second end of the blade profile, sweeping the grind head to an end pitch angle negatively angularly offset from a third local tangent proximal the second end of the blade profile to locate aft grind surfaces of the interdigitated grind wheels in contact with a tip of the blade.

10. The method of claim 1:

wherein recording the sequence of vertical positions of segments of the edge of the blade comprises:

as the grind head retracts from proximal the initial longitudinal position toward the longitudinal end position, recording the sequence of vertical positions of segments of the edge of the blade paired with concurrent longitudinal positions of the grind head relative to the vice;

calculating a polynomial function relating longitudinal positions and vertical positions, in the sequence of vertical positions, in a machine coordinate system; and storing the polynomial function as the blade profile; and wherein longitudinally retracting the grind head and pitching the grind head during the grind cycle comprises driving a first actuator configured to adjust a pitch of the grind head, driving a second actuator configured to move the grind head longitudinally relative to the vice, and a third actuator configured to move the vice vertically relative to the grind head to trace a grind surface on the grind wheel, in contact with the blade, along the blade profile.

11. The method of claim 10, further comprising:

detecting a point of the blade at a terminus of the sequence of vertical positions; and extending the blade profile by a lead-out distance past a longitudinal position of the point of the blade;

during the grind cycle:

lowering the vice to an initial vertical position;

advancing the grind head longitudinally toward the initial longitudinal position;

setting the grind head at a pitch angle substantially parallel to a first tangent on a first end of the blade profile; and raising the vice to a first vertical position defined at the first end of the blade profile to locate a rear of the edge of the blade in contact with the grind wheel; and in response to conclusion of the grind cycle:

deactivating a grind actuator coupled to the grind wheel;

lowering the vice to the initial vertical position; and retracting the grind head to the longitudinal end position.

12. The method of claim 1, further comprising:

during the grind cycle, activating a vacuum unit fluidly coupled to the grind head; and in response to conclusion of the grind cycle, automatically deactivating the vacuum unit.

13. The method of claim 1, further comprising:

in response to conclusion of the grind cycle:

advancing the grind head to proximal the initial longitudinal position;

while longitudinally retracting the grind head from proximal the initial longitudinal position toward the longitudinal end position, recording a second sequence of vertical positions of segments of the edge of the blade based on outputs of the sensor;

surveying the second sequence of vertical positions for discontinuities;

in response to detecting a discontinuity, in the second sequence of vertical positions, exceeding a threshold dimension:

advancing the grind head, relative to the vice, to proximal the initial longitudinal position;

actuating the grind wheel;

longitudinally retracting the grind head, relative to the vice, from proximal the initial longitudinal position toward the longitudinal end position along the blade profile; and while longitudinally retracting the grind head, pitching the grind head, relative to the vice, to maintain the axis of the grind wheel substantially parallel to local tangents along the blade profile.

14. The method of claim 1, further comprising:

calculating a variance of the sequence of vertical positions from the blade profile;

calculating a target number of grind cycles proportional to the variance; and executing the target number of grind cycles.

15. The method of claim 1:

calculating a variance of the sequence of vertical positions from the blade profile; and in response to the variance exceeding a threshold value:

characterizing the blade as serrated;

rejecting the knife; and serving a prompt to remove the knife from the vice.

16. A method for automatically re-sharpening a knife comprising:

receiving a knife at a vice;

during a scan cycle:

scanning a grind head over a longitudinal scan distance between an initial longitudinal position proximal the vice and a longitudinal end position; and recording a sequence of vertical positions of segments of an edge of a blade of the knife at longitudinal positions of the grind head along the longitudinal scan distance based on outputs of a sensor arranged in the grind head;

calculating a blade profile for the knife based on the sequence of vertical positions; and during a grind cycle:

actuating a grind wheel in the grind head;

driving the grind head along the longitudinal scan distance; and while driving the grind head along the scan distance, pitching the grind head to maintain an axis of the grind wheel substantially parallel to segments of the blade profile corresponding to longitudinal positions of the grind head, relative to the vice.

17. The method of claim 16:

wherein actuating the grind wheel comprises actuating a grind wheel actuator to counter-rotate a pair of interdigitated grind wheels arranged in the grind head, the interdigitated grind wheels defining nonlinear grind surface profiles; and wherein driving the grind head along the longitudinal scan distance and pitching the grind head during the grind cycle comprises:

with the grind head located at a first longitudinal position defined by a first end of the blade profile, setting the grind head at a start pitch angle positively angularly offset from a first local tangent proximal the first end of the blade profile to locate fore grind surfaces of the interdigitated grind wheels in contact with a rear of the blade;

while driving the grind head from the first longitudinal position to a second longitudinal position defined by a midpoint of the blade profile, sweeping the grind head to a center pitch angle parallel to a second local tangent on the midpoint of the blade profile to locate a center grind surface of the interdigitated grind wheels in contact with a midpoint of the blade; and while retracting the grind head from the second longitudinal position to a third longitudinal position defined by a second end of the blade profile, sweeping the grind head to an end pitch angle negatively angularly offset from a third local tangent proximal the second end of the blade profile to locate aft grind surfaces of the interdigitated grind wheels in contact with a tip of the blade.

18. The method of claim 16:

wherein recording the sequence of vertical positions of segments of the edge of the blade comprises:

as the grind head retracts from proximal the initial longitudinal position toward the longitudinal end position, recording the sequence of vertical positions of segments of the edge of the blade paired with concurrent longitudinal positions of the grind head relative to the vice;

calculating a polynomial function relating longitudinal positions and vertical positions, in the sequence of vertical positions, in a machine coordinate system; and storing the polynomial function as the blade profile; and wherein driving the grind head along the longitudinal scan distance and pitching the grind head during the grind cycle comprises driving a first actuator configured to adjust a pitch of the grind head, driving a second actuator configured to move the grind head longitudinally relative to the vice, and driving a third actuator configured to move the vice vertically relative to the grind head to trace a grind surface on the grind wheel, in contact with the blade, along the blade profile.

19. The method of claim 16:

further comprising, during the scan cycle:

lowering the vice, relative to the grind head, to an initial vertical position;

setting the grind head at a nominal pitch angle substantially parallel to the vice; and raising the vice, relative to the grind head, until an edge of the blade detected aligns with a vertical center of a field of view of the sensor, the sensor comprising a column of optical detectors;

wherein recording the sequence of vertical positions of segments of the edge of the blade comprises:

retracting the grind head along a series of longitudinal waypoints between the initial longitudinal position and the longitudinal end position; and for each waypoint, in the series of waypoints, occupied by he grind head:

detecting a vertical height of a segment of the edge of the blade in the field of view of the sensor;

calculating a vertical position of the segment of the edge of the blade in machine coordinates based on a combination of the vertical height of the segment of the edge in the field of view of the sensor and a concurrent vertical position of the vice, relative to the grind head;

storing the vertical position of the segment of the edge of the blade with a concurrent longitudinal position of the grind head, relative to the vice; and adjusting a vertical position of the vice, relative to the grind head, to approximately center the segment of the edge of the blade in the field of view of the sensor.

20. The method of claim 16, wherein receiving the knife comprises, at the vice:

receiving the blade of the knife at the vice with a spine of the blade facing downward toward a vice stop within the vice and with the edge of the blade facing upwardly from the vice; and responsive to manual input at a user interface, triggering a vice actuator coupled to the vice to clamp jaws of the vice to the blade proximal the spine and adjacent a bolster of the knife with a tip of the blade cantilevered off of the vice toward the longitudinal end position.

* * * * *